US006889493B2

(12) United States Patent
Zewde et al.

(10) Patent No.: US 6,889,493 B2
(45) Date of Patent: May 10, 2005

(54) APPARATUS FOR FORMING A SPLICED YARN

(75) Inventors: Anteneh Zewde, Wilmington, DE (US); Joseph Anthony Perrotto, Landenberg, PA (US); Mark Jefferson Whitley, Stratford, NJ (US)

(73) Assignee: JP Morgan Chase Bank, N.A., Houston, TX (US)

( * ) Notice: Subject to any disclaimer, the term of this patent is extended or adjusted under 35 U.S.C. 154(b) by 123 days.

(21) Appl. No.: 10/323,451

(22) Filed: Dec. 19, 2002

(65) Prior Publication Data

US 2004/0118098 A1 Jun. 24, 2004

(51) Int. Cl.[7] ..... B65H 69/06

(52) U.S. Cl. ..... 57/22; 57/23; 57/202; 242/475.1; 242/555

(58) Field of Search ..... 57/22, 23, 202; 242/475.1–475, 555–556; 28/219

(56) References Cited

U.S. PATENT DOCUMENTS 4,917,285 A * 4/1990 Shosie ..... 228/5.7
4,938,268 A * 7/1990 Shaw ..... 139/116.2
5,308,007 A * 5/1994 Stroszynski ..... 242/555.4
5,514,237 A * 5/1996 Emenaker et al. ..... 156/159
5,618,377 A * 4/1997 Kaneko et al. ..... 156/504

* cited by examiner

*Primary Examiner*—John J. Calvert
*Assistant Examiner*—Shaun R Hurley
(74) *Attorney, Agent, or Firm*—Connolly Bove Lodge & Hutz LLP; Myron K. Wyche

(57) ABSTRACT

Apparatus for forming a spliced yarn includes a yarn conduction member with an intermingling jet disposed forwardly thereof. The yarn conduction member has respective yarn conduction channels through which the first and second yarns are conveyed to the intermingling jet. The yarn conduction member has a first and second knife blade disposed adjacent to one of the yarn conduction channels. The first and second knives are insertable into and retractable from the channel to which they are adjacent. In the inserted position the passage in the knife aligns with the channel into which it is inserted, while in the retracted position the solid portion of the blade interdicts the passage to prevent movement of a yarn therethrough.

5 Claims, 20 Drawing Sheets

24
146A
144A
148A
150A
128A
160A
162A
120A
126A
130A
168A
24-1
170A
68A
120B
128B
126B
146B
130B
79A
76A
80A
93B
110A
93A
44R
95A
114A
12A
95B
110B
42T
42E
42P
42
42C
42R
92A
30L
30A'
44F
30
30F
30P
30A
42F
22P
20P
30R

APPARATUS FOR FORMING A SPLICED YARN

CROSS REFERENCE TO RELATED APPLICATION

Subject matter disclosed herein is disclosed and claimed in the following co-pending application:

"Spliced Yarn And Method For Forming The Same", filed contemporaneously in the names of present inventors and assigned to the assignee of the present invention (U.S. application Ser. No. 10/323,396 filed Dec. 19, 2002).

BACKGROUND OF THE INVENTION

1. Field of the Invention

This invention relates to a method and apparatus for forming a spliced yarn.

2. Description of the Prior Art

Space-dyed yarns are carpet yarns that change color at predetermined intervals along the length of the yarn. Carpets manufactured using space-dyed yarn are desirable owing to the pleasing aesthetic provided by the variegated colors of the spaced-dyed yarns.

The color changes along the length of a space-dyed yarn is accomplished by one of two primary methods. In the first process, a white yarn is passed through a multicolor dying machine wherein the yarn is held against rollers containing different colored dyes. This process is very flexible, but it is quite slow and requires a large investment in associated dryers and heat-setting equipment. Moreover, the color produced to a yarn by dyeing are not as durable and vibrant as the color imparted to a solution-dyed yarns. In a solution dyed yarn the color pigments are incorporated into the polymer pellets from which the yarn is made.

The second process also begins with a white yarn which is knit into a fabric. The fabric is then printed with a multicolored pattern Once dried and heat-set, the fabric is unraveled and rewound into a package. This process is relatively slow and expensive. The yarns produced by this process are seen to suffer the same disadvantages as to color durability and vibrancy as the yarn produced by the other process.

In view of the foregoing it is believed advantageous to provide a process and an apparatus for producing a multicolored yarn that is able to provide substantially the same multicolor appearance as a space-dyed yarn.

SUMMARY OF THE INVENTION

The present invention is directed to a method and an apparatus for producing a spliced yarn comprising alternating predetermined lengths of a first and a second yarn and to the yarn so formed.

In accordance with the present invention a predetermined length of a first yarn is drawn through an intermingling jet. A leading portion of a second yarn is forwarding into the intermingling jet and into overlapping relationship with a trailing portion of the first yarn. Using a pressurized fluid the overlapped portions of the first and second yarns are intermingled, thereby to splice the leading portion of second yarn to the trailing portion of the first yarn. The first yarn is then severed, and the spliced portion and a predetermined length of the second yarn are drawn through the intermingling jet. The cycle is repeated with the second yarn being the currently drawn yarn and the first yarn being forwarded into overlapping relationship therewith.

Preferably the yarns are held in the intermingling jet, as by a clamp disposed forwardly of the jet, while the intermingled splice is formed. The pressurized fluid forming the intermingled splice has a pressure in the range from sixty (60) to one hundred (100) pounds per square inch (413.4 to 689.4 Kilopascals), and more preferably, a pressure in the range from sixty (60) to eighty (80) pounds per square inch (413.4 to 551.2 Kilopascals). (One pound per square inch is 6.894757 Kilopascals.) Each splice so formed must be able to withstand a tension force of at least 6.8 pounds (3.1 kilograms). Yarn splices formed at the higher pressures in the above-mentioned ranges are be able to withstand a tension force of at least 8.3 pounds (about 3.8 kilograms).

The predetermined lengths of the first and second yarn may be equal or different.

The first and second yarns are of may be made differently colored. Preferably the first and second yarns are solution dyed to be differently colored. However, it lies within the contemplation of the present invention to utilize yarns that have different dye affinities so that the yarns may be differently colored at a later time. The yarns may be formed from the same or different polymer materials, and may be of the same or different deniers.

The apparatus for forming the spliced yarn of the present invention includes a yarn conduction member with an intermingling jet disposed forwardly thereof. The yarn conduction member has respective yarn conduction channels through which the first and second yarns are conveyed to the intermingling jet. The axis of each yarn conduction channel from the inlet to the outlet of the member is a straight line, with no bends or deviations. The yarn conduction member has a knife blade disposed adjacent to a respective yarn conduction channel. Each knife blade has a tip thereon. Each blade has a passage defining a cutting edge formed in one portion thereof and a solid portion disposed between the passage and the tip of the blade. The length of the solid portion of the blade being at least equal to the dimension of the passage to which the blade is adjacent. The first and second knives are insertable into and retractable from the channel to which they are adjacent. In the inserted position the passage in the knife aligns with the channel into which it is inserted, while in the retracted position the solid portion of the blade interdicts the passage to prevent movement of a yarn therethrough. Movement of each knife from the inserted to the retracted positions brings the cutting edge into operative cutting contact with the yarn conduction member thereby severing a yarn extending through the passage in the knife. A first and a second holding cap is disposed adjacent to one of the yarn conduction channels and proximal to a respective one of the knives. Each cap is retractable from and insertable into the channel adjacent thereto in correspondence with the respective insertion and retraction of the proximal knife. When inserted into a channel the cap is disposed into abutting contact with the yarn conduction member and serves to hold a yarn extending through a channel against the yarn conduction member. The yarn conduction member is preferably formed from conjoined first and second housing members, one of which is fabricated from a transparent material.

BRIEF DESCRIPTION OF THE DRAWINGS

The invention will be more fully understood from the following detailed description thereof, taken in connection with the accompanying drawings, which form a part of this application and in which:

FIG. 3 is cross sectional view of the yarn splicing apparatus taken along section lines 3—3 in FIG. 2, while

FIG. 4 is cross sectional view of the yarn splicing apparatus taken along section lines 4—4 in FIG. 2, while

FIGS. 6A through 6L are stylized pictorial views illustrating the operation of the yarn splicing apparatus for forming splices between a first and a second yarn in accordance with the present invention.

DETAILED DESCRIPTION OF THE INVENTION

Figure 1:
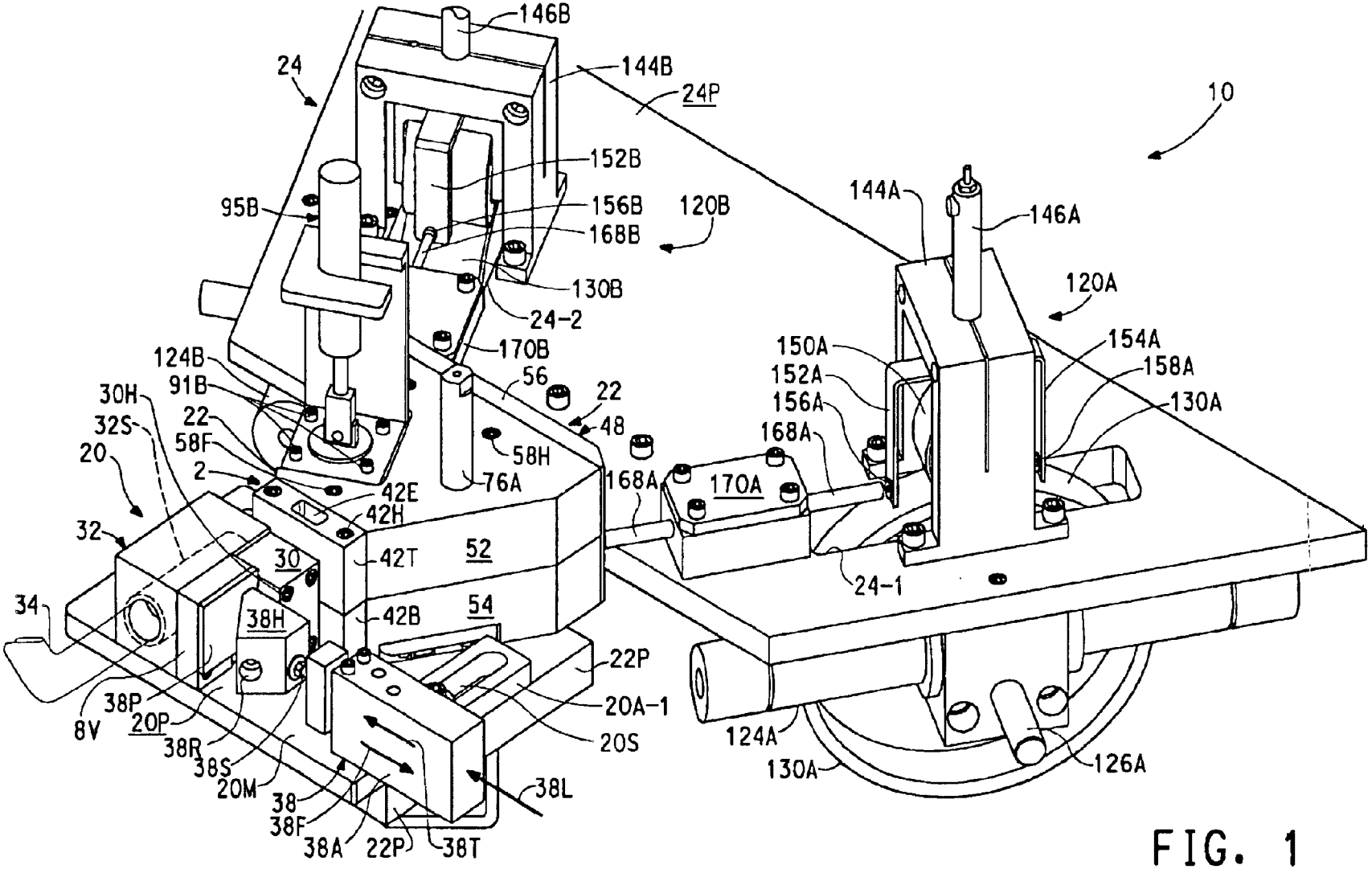
FIG. 1 is a perspective view of a yarn splicing apparatus for forming splices between a first and a second yarn in accordance with the present invention.

Throughout the following detailed description similar reference numerals refer to similar elements in all figures of the drawings.

Figure 7:
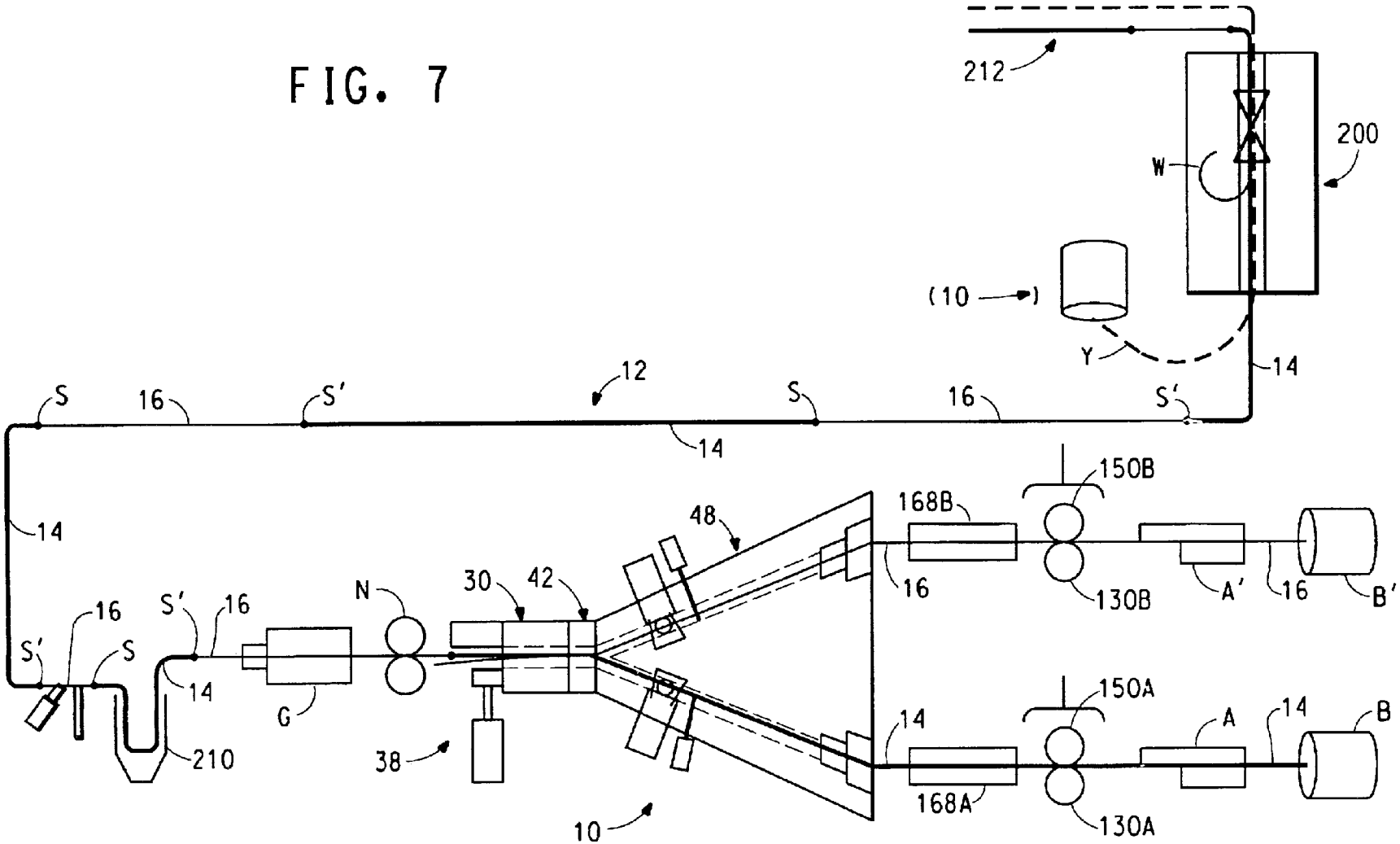
FIG. 7 is a diagrammatic illustration of the use of the yarn splicing apparatus of the present invention.

Referring to FIGS. 1 through 4A respectively shown are perspective, plan and cross sectional views of a yarn splicing apparatus generally indicated by the reference numeral 10 for forming a spliced yarn 12 diagrammatically indicated in FIG. 7, for example) from alternating predetermined lengths of a first yarn 14 and a second yarn 16 in accordance with the present invention. In one especially preferred use the spliced yarn 12 is used to form a wrapped composite yarn 212.

The first and second yarns 14, 16 may be any multifilament yarn capable of being intermingled using an intermingling jet. By "intermingled" it is meant that the yarns are combined (interlaced) using an intermingling jet wherein a fluid (typically air) is used to create turbulence that entangles the filaments of continuous filament yarns without forming loops. The yarns 14, 16 can be made from the same or different polymer materials and/or can be the same of different deniers. Preferably the yarns 14, 16 are each multifilament bulked continuous filament nylon yarns, although multifilament yarns made of other materials (such as polyester or polypropylene) capable of being intermingled with each other can be used.

In order to provide the desired aesthetic appearance the first and second yarns 14, 16 are differently colored. The difference in coloration may be imparted in any convenient fashion. Preferably, the first and second yarns are solution dyed to be differently colored. However, it lies within the contemplation of the present invention that different coloration to the yarn may be imparted by pre-dyeing the yarns or by forming the yarns from polymers having different dye affinities.

The yarn splicing apparatus 10 includes a yarn interlace module 20, a yarn conduction module 22, and a yarn feed module 24, each mounted to a respective mounting plate 20P, 22P and 24P. The mounting plate 20P for the yarn interlace module 20 is a generally U-shaped member having a main body portion 20M from which a pair of arms 20A-1, 20A-2 rearwardly project. To facilitate access for maintenance or to adjust the relative position of yarn interlace module 20 with respect to the yarn conduction module 22 the mounting plate 20P is movably mounted near the forward edge of the mounting plate 22P via respective fasteners 20B-1, 20B-2, such as hexagonal socket cap screws and associated washers. The shank of each screw 20B-1, 20B-2 extends through a respective slot 20S provided in each arm 20A-1, 20A-2.

Figures 3, 3A:
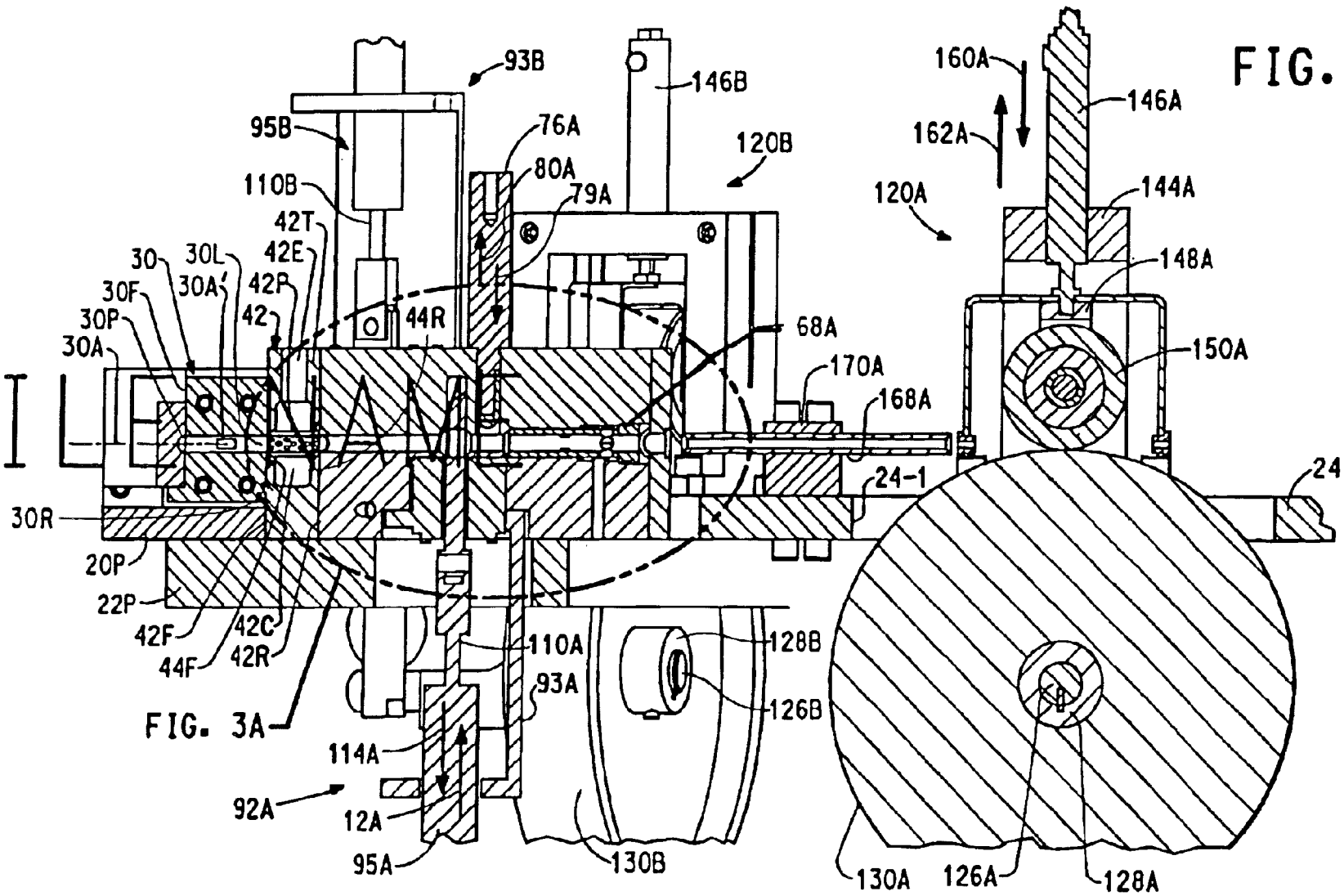
Figure 3A:
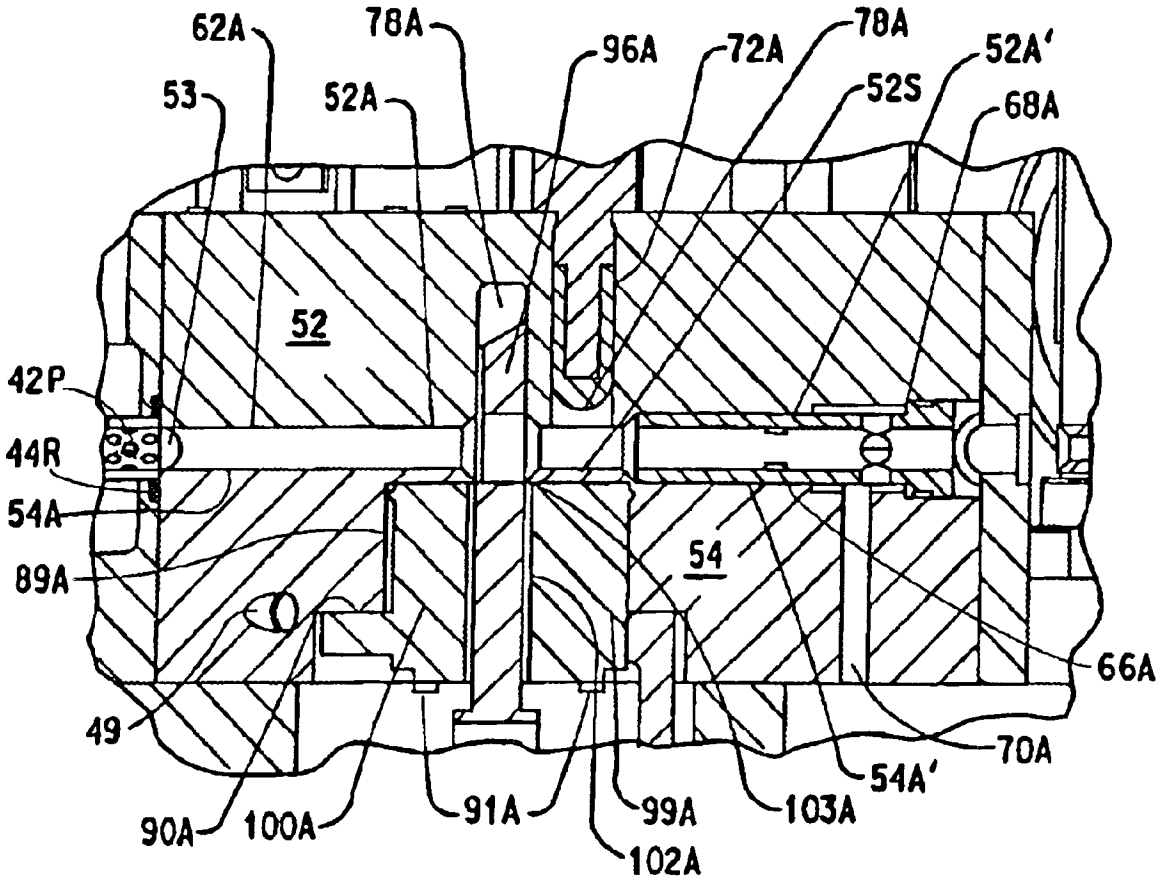
FIG. 3A is an enlarged view of the circled portion of FIG. 3.
Figure 4:
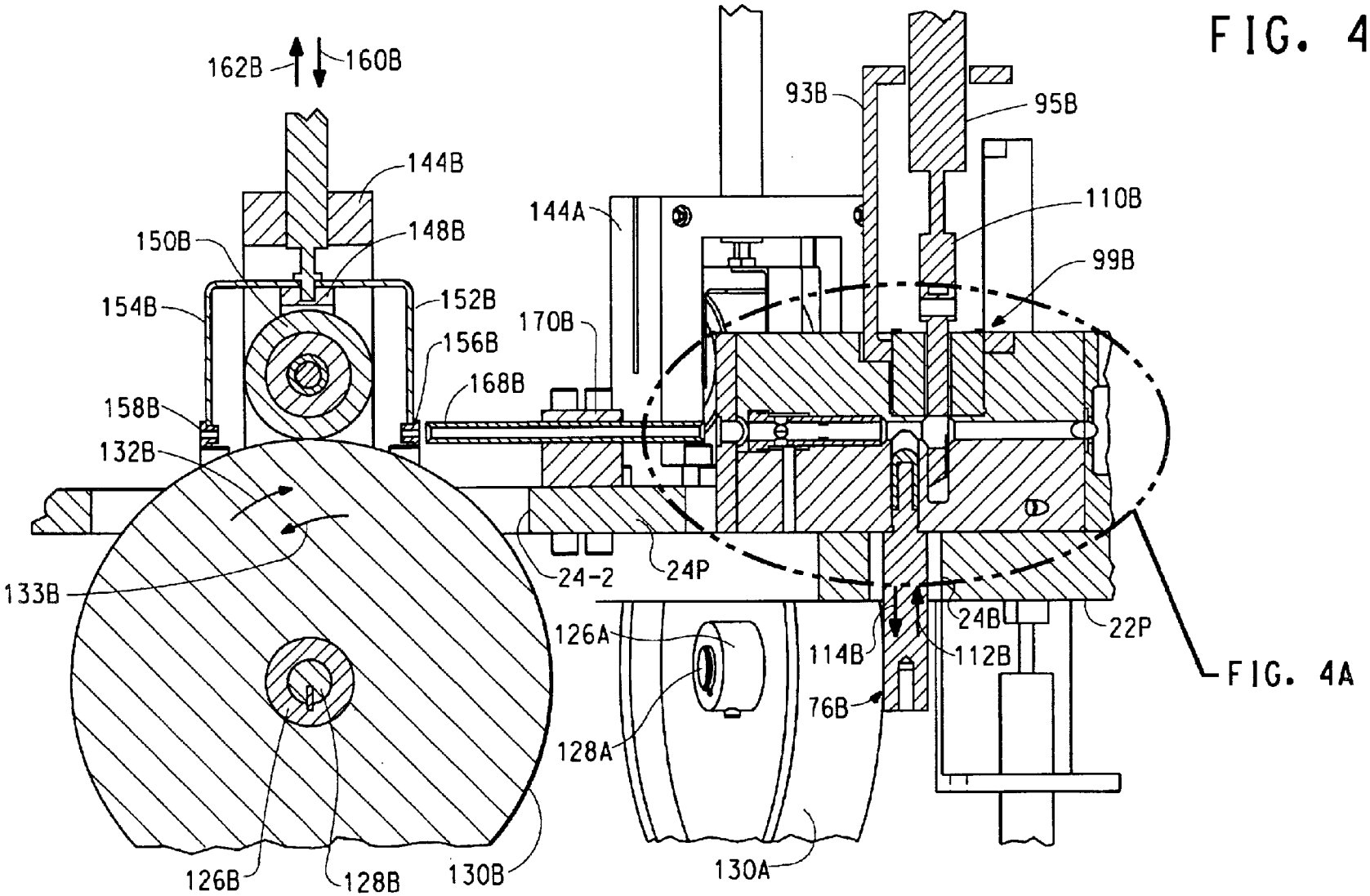
Figure 4A:
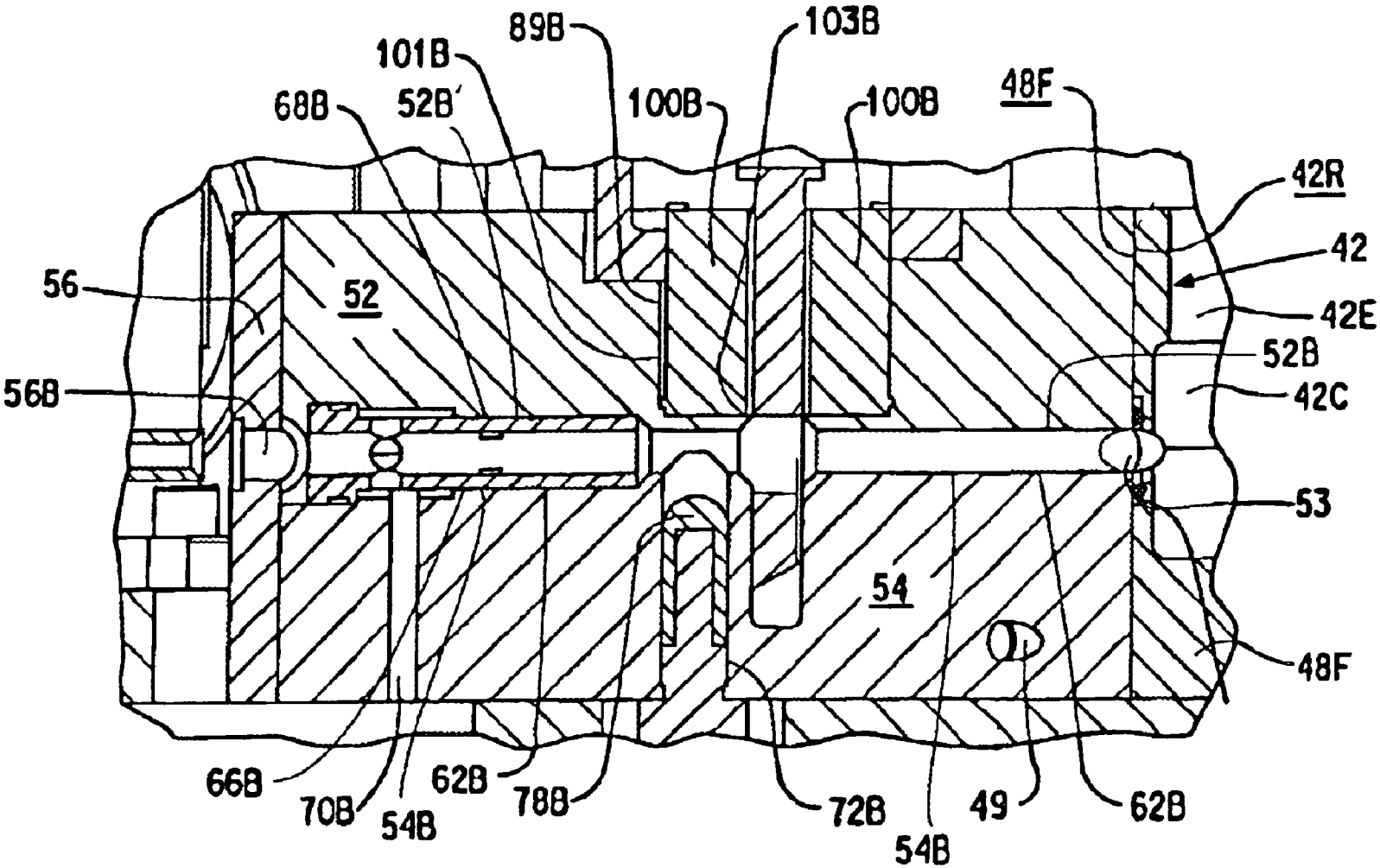
FIG. 4A is an enlarged view of the circled portion of FIG. 4.

As is perhaps best seen in FIGS. 1 and 4 the yarn interlace module 20 includes an jet block 30 that has an intermingling channel 30C (FIG. 3) extending from an inlet port 30L formed in the rear face 30R of the block 30 to an outlet port 30P provided in the forward face 30F thereof. A supply channel 30S for a pressurized intermingling fluid is formed within the body of the block 30. The supply channel 30S is arranged such that the pressurized intermingling fluid is introduced into the intermingling channel 30C along the axis 30A thereof. The axis 30A' of the supply channel 30S should be oriented perpendicularly to the axis 30A of the intermingling channel 30C.

A jet found suitable for use as the intermingling jet in the present invention has an intermingling channel 30C of circular cross-section with a diameter of 0.204 inches (0.52 centimeters). The supply channel 30S is generally rectangular in cross section with the opening having a length dimension of 0.195 inches (about 0.50 centimeters) and a width of 0.107 inches (about 0.27 centimeters). The overall length of the supply channel being 0.518 inches (about 1.3 centimeters).

A pressurized fluid supply manifold block 32 (FIG. 1) is fastened (as by hexagonal cap screws 30H) adjacent to the interlace jet block 30 in fluid communication with the supply channel 30S. A pressurized intermingling fluid (e.g., air, water) is conducted from a supply conduit diagrammatically indicated by reference character 34 (FIG. 1) into the supply channel 30S via a supply passage 32S formed in the manifold block 32. As will be developed the pressure of the intermingling fluid upon entry into the intermingling channel 30C should be in the range for sixty (60) to one hundred (100) pounds per square inch (413.4 to 689.4 Kilopascals). More preferably, the pressure of the intermingling fluid upon entry into the intermingling channel 30C should be in the range for sixty (60) to eighty (80) pounds per square inch (413.4 to 551.2 Kilopascals). (One pound per square inch is 6.894757 Kilopascals.)

A yarn clamp assembly 38 (FIGS. 1, 2) is also mounted to the mounting plate 20P adjacent to the forward face 30F of the interlace jet block 30. The clamp assembly 38 includes a clamp head 38H and associated clamp anvil 38V. The clamp head 38H has a relief passage 38R extending therethrough. The relief passage 38R is positioned in adjacent to and in fluid communication with the outlet port 30P in the forward face 30F of the jet block 30. The major face of the anvil 38V has an elastomeric pad 38P thereon. Suitable for use as the pad 38P is a 70A durometer neoprene rubber pad available from McMaster-Carr Supply Company, Elmhurst, Ill., under model number 8463K62. The anvil 38V and the clamp head 38H are positioned on the plate 20P in confronting relationship on opposite sides of the axis 30A of the interlace channel 30C.

Figure 2:
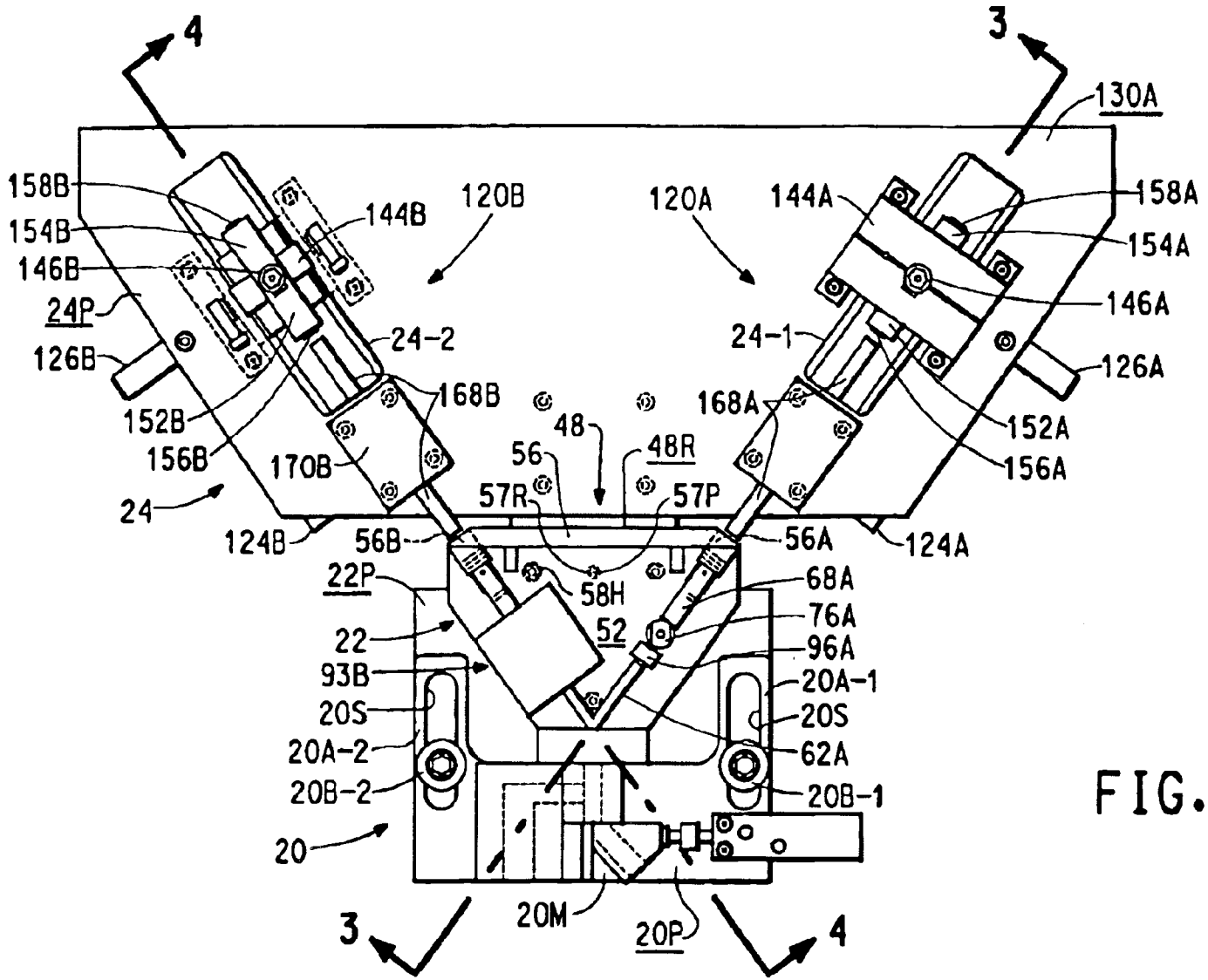
FIG. 2 is a plan view of the yarn splicing apparatus shown in FIG. 1.

The clamp head 38H is attached to the shaft 38S of an actuator 38A fastened to the plate 20P (as by hexagonal socket cap screws and associated washers). The clamp head 38H is reciprocally moveable toward and away from the anvil 38A in the directions of respective arrows 38T (movement toward anvil) and 38F (retraction from anvil). Actuating fluid under pressure is applied to the actuator 38A of the clamp assembly via a pressurized air supply line diagrammatically indicated by reference character 38L (FIG. 2). Suitable for use as the actuator 38A is the air cylinder actuator manufactured by SMC Inc., Indianapolis, Ind., and sold as model number ZCUKC 16–10D.

The yarn conduction module 22 includes a relief housing 42 and a yarn conduction block 48, both affixed to the mounting plate 22P.

The pressurized fluid relief housing 42 is located near the forward margin of the mounting plate 22P of the yarn conduction module 22. The relief housing 42 is formed from upper and lower blocks 42T, 42B (FIGS. 1, 4) joined together by fasteners 42H (such as hexagonal cap screws). An escape passage 42E extends through the upper block 42T into fluid communication with a relief chamber 42C (FIG. 3) formed on the interior of the housing 42. A perforated relief tube 42P (FIG. 3) is received in mounting grooves provided in the respective front and the rear faces 42F, 42R of the housing 42. The front face 42F of the housing 42 has a generally circular groove that receives an annular gasket 44F (FIG. 4). The gasket 44F surrounds and seals the interface between the front surface 42F of the housing 42 and the rear surface 30R of the interlace jet block 30. Similarly, an annular gasket 44R received within a groove formed in the rear face 42R of the housing 42 surrounds and seals the interface between the rear surface 42R of the housing 42 and the forward face 48F of the yarn conduction block 48 (FIGS. 3, 4). The housing 42 is joined to the forward end face of the yarn conduction block 48 by fasteners 49, such as hexagonal socket cap screws.

The yarn conduction block 48 is a generally triangularly shaped member preferably formed from conjoined upper and lower housings 52 and 54, respectively. The rearward faces of the housings 52, 54 receive a retainer plate 56 for a purpose to be described. The retainer plate is secured to the housings 52, 54 by suitable fasteners. The plate 56 has a pair of ports 56A, 56B that extend through the side margins thereof.

Coplanar regions of the upper and lower housings 52 and 54 define the front surface 48F of the yarn conduction block 48. The exterior surfaces of the retainer plate 56 define the rear surface 48R of the yarn conduction block.

The upper and lower housings 52, 54 are registered with respect to each other by registration pins 57P (FIG. 2) and corresponding recesses 57R. The housings 52, 54 are held in the conjoined relationship illustrated in the drawings by suitable fasteners, such as hexagonal socket cap screws 58H. In practice, in order to afford visual access to the yarn conduction path and to verify operability the upper housing 52 is preferably fabricated from a transparent material, such as an acrylic plastic manufactured and sold by E. I. Du Pont de Nemours and Company under the trademark Lucite®. The lower housing 54 and the retainer plate 56 may be fabricated from any suitable machinable material, such as aluminum.

As is best seen in FIGS. 2 through 4 the mating surfaces of each of the upper and lower housings 52, 54 have a pair of generally cylindrical grooves 52A, 52B, 54A, 54B machined therein. When the housings 52, 54 are mated confronting pairs of grooves 52A—54A, 52B–54B, respectively, register to define enclosed yarn conduction channels 62A (FIG. 3), 62B (FIG. 4) that extend entirely through the block 48. The rearward ends of the channels 62A, 62B respectively align with ports 56A, 56B formed in the side margins of the retainer plate 56. The forward ends of the channels 62A, 62B meet each other at a yarn outlet port 53 defined in the front surface 48F of the yarn conduction block 48. Thus, a conduction path for each yarn 14, 16 is defined through the yarn conduction block 48 from the ports 56A, 56B defined in the rear surface 48R to the outlet port 53 formed in the front surface 48F of the block 48. The port 53 communicates with the end of the perforated tube 42P supported at the rear surface 42R of the air relief housing 42. As best seen in the plan view of FIG. 2 the central axes of the yarn conduction channels 62A, 62B extend as straight lines directly, without bends or deviations, from the respective inlet ports 56A, 56B to their juncture at the outlet port 53.

The grooves 52A, 52B, 54A, 54B formed in the housings 52, 54 are widened in the rearward regions 52A', 52B', 54A', 54B' such that an enlarged counterbored jet cavity 66A, 66B is created in the rearward portion of each channel 62A, 62B. An aspirating forwarding jet 68A, 68B is positioned in each jet cavity 66A, 66B. Suitable for use as the jet 68A, 68B is the device manufactured and sold by Air Vac Inc., Seymour, Conn., as model number ITD-147. The retainer plate 56 serves to hold each of the jets 68A, 68B in the jet cavity 66A, 66B. An aspirating fluid passage 70A, 70B is provided through the lower housing 54 to supply pressurized aspirating fluid to each respective jet 68A, 68B.

As best seen in FIG. 3 a closed access passage 72A extends through the body of the upper housing 52 and intersects the yarn conduction channel 62A forwardly of the aspirating jet 68A. The closed bottom of the passage 72A is defined by a surface 52S formed by the lower housing 54. The upper portion of the passage 72A is threaded.

An analogous structure is provided in the lower housing 54, as is illustrated in FIG. 4. A closed access passage 72B extends through the body of the lower housing 54 and intersects the yarn conduction channel 62B forwardly of the aspirating jet 68B. The closed bottom of the passage 72B is defined by a surface 54S formed by the upper housing 52. The entrance of the passage 72B is threaded. An opening 74 is formed in the mounting plate 22P in registry with the access passage 72B.

A respective actuating assembly 76A, 76B is threaded into each passage 72A, 72B. Suitable for use as the actuator 76A, 76B is the device manufacture by Bimba Manufacturing Company, Monee, Ill., as 01.5, ½" stroke, type 316 air cylinder.

Each actuating assembly includes a respective piston rod 77A, 77B. Each piston rod has a holding member, or holding cap, 78A, 78B thereon. The caps 78A, 78B are fabricated of an elastomeric or polymeric material that does not scratch or mar the surfaces of channel into which it projects. A suitable cap is a 55 durometer rubber cap available from McMaster-Carr Supply Company, Elmhurst, Ill., under model number 6448K45. The piston rods 77A, 77B of each actuating assembly are reciprocally movable within the cylinder of the actuator in respective holding directions 79A, 79B and retraction directions 80A, 80B.

Movement of the piston rod 77A, 77B in the holding direction 79A, 79B brings the holding cap 78A, 78B disposed at the end thereof into its adjacent associated yarn conduction channel 62A, 62B and into abutting contact with respective bottom surface 54S, 54S' in lower and upper housings 54, 52. Movement in the counter directions 80A, 80B retracts the cap 78A, 78B from its respective associated conduction channel 62A, 62B.

As seen in FIG. 3 the body of the upper housing 52 has an enclosed pocket 78A that communicates with the yarn conduction channel 62A just forwardly of the access passage 72A. A counterbored mounting opening 89A is formed in the lower housing 54 in alignment and communication with the pocket 78A. The counterbore of the mounting opening 89A defines a shoulder 90A.

An analogous structure is provided in connection with the channel 62B. With reference to FIG. 4 the body of the lower housing 54 has an enclosed pocket 88B that communicates with the yarn conduction channel 62B just forwardly of the access passage 72B. A counterbored mounting opening 89B is formed in the upper housing 52 in alignment and communication with the pocket 88B. The counterbored portion of the mounting opening 89A defines a shoulder 90A.

A knife assembly 92A, 92B is respectively mounted in the mounting openings 89A, 89B and held in place against the respective upper and lower housings 52, 54 by suitable fasteners 91A, 91B, such as hexagonal socket cap screws. Generally suitable for use as the knife assembly 92A, 92B is a yarn cutter manufactured and sold by Slack and Parr, Charlotte, N.C., as number A301330, model YCDP360-DP, that has been modified from commercially available model in a manner to be discussed shortly.

Figure 5:
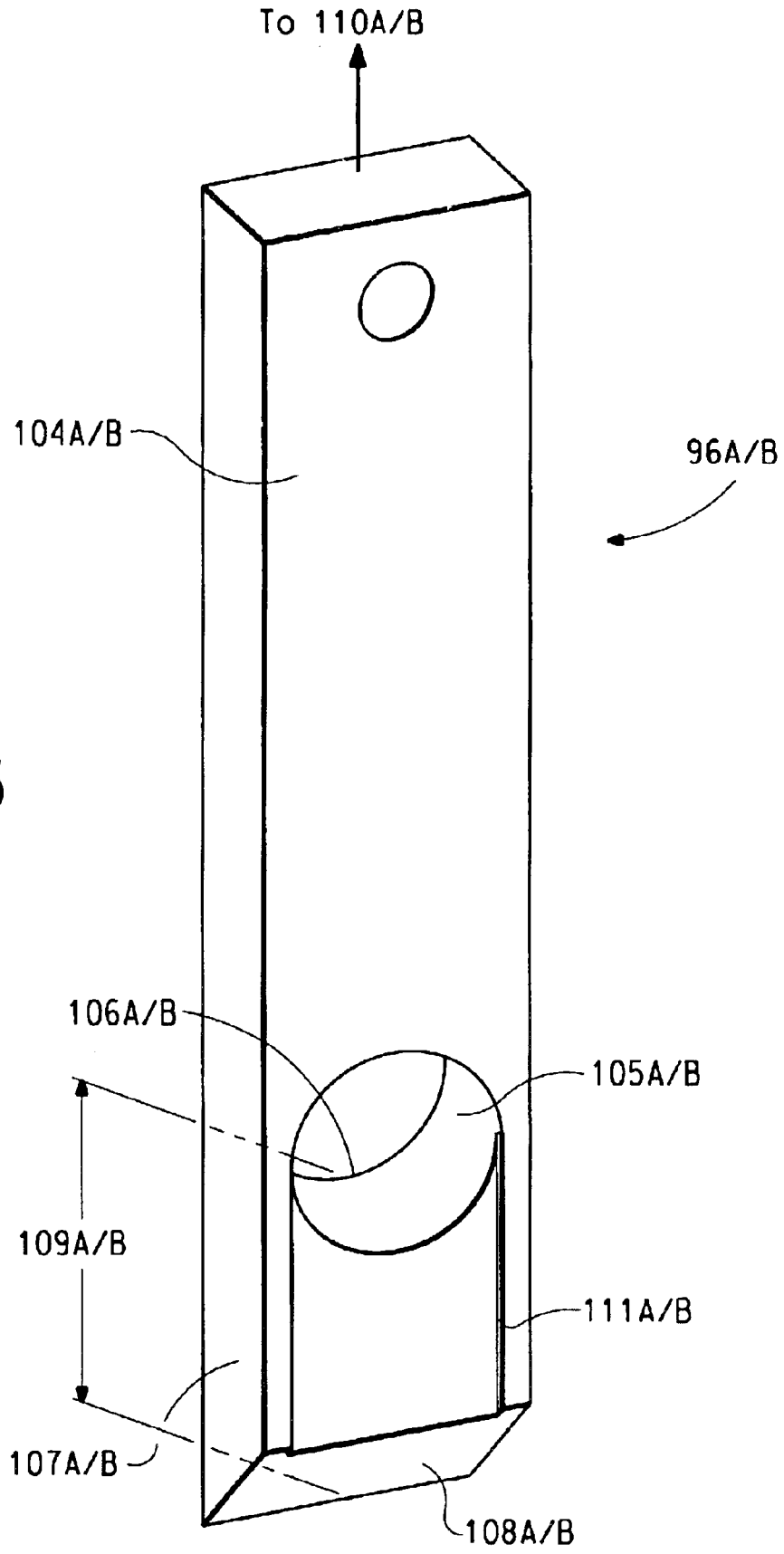
FIG. 5 is a perspective view of a knife used in the yarn splicing apparatus shown in FIG. 1.

The knife assembly 92A includes a housing 93A supporting a cutter head 94A and an actuator 95A. The cutter head 94A includes a movable blade 96A and a fixed blade 99A. A detail drawing of the movable blade 96A of the knife assembly is shown in FIG. 5.

The fixed blade 99A and an associated pressure plate 100A are held together within the housing 93A by a spring band 101A. The fixed blade 99A and the pressure plate 100A each have a cutout formed therein that cooperate to define a rectangular opening 102A through which the movable blade 96A extends. The edge 103A of the fixed blade 99A defines the fixed cutting edge of the cutter head within the yarn conduction block 48.

The movable knife blade 96A includes a generally rectangular body portion 104A through which a passage 105A is formed. The diametrical dimension of the passage 105A is at least equal to the diameter of the circular channel 62A with which it is associated. The edge of the passage 105A defines the movable cutting edge 106A of the cutter head. The portion 107A of the blade remaining between passage 105A and the tip 108A of the blade has a length dimension 109A is at least equal to the diametrical dimension of the yarn conduction channel with which the blade is associated. The other end of the movable blade 96A is attached to a piston rod 110A that extends from the cylinder of the actuator 95A. The actuator 95A is itself supported above and on the axis of the mounting opening by a yoke portion of the housing 93A. The back side of the movable blade 96A (i.e., the side facing the pressure plate 100A) is relieved (as at 111) to insure that yarn is cut only at the interface of the cutting edges on the fixed and movable blades.

The actuator is operative to reciprocate the movable blade 96A in opposed directions 112A, 114A. Movement in the direction 112A inserts the movable blade 96A into the pocket 88A, while movement in the opposed direction 114A retracts the movable blade 96A therefrom. The passage 105A is located in the movable blade 96A such that, when fully inserted into the pocket 88P, the passage 105A is aligned with the conduction channel 62A. However, when retracted, the solid portion 107A of the movable blade 96A blocks the channel 62A, preventing movement of yarn therethrough. Moreover, as the movable blade 96A retracts the cutting edge 106A thereon is brought into cutting engagement with the fixed cutting edge 103A on the fixed blade 99A.

An analogous knife assembly 92B structurally and operational identical to the assembly 92A is mounted into the mounting opening 90B (FIG. 4). As the movable blade 96A reciprocates in opposed interdiction and retraction directions 112B, 114B it is inserted into or retracted from the pocket 88B. The cutting action occurs when the cutting edge 106A on the movable blade 96B is retracted past the cutting edge 103A on the fixed blade 99A.

The yarn feed module 24 includes pair of feed assemblies 120A, 120B, respectively. Each feed assembly is operative to feed a respective yarn 14, 16 to a respective one of the channels 62A, 62B formed in the yarn conduction block 22.

Only the feed assembly 120A (FIG. 3) is described in detail, it being understood that the corresponding structural and operational elements of the feed assembly 120B are indicated in the drawings (particularly FIG. 4) by corresponding reference numerals denoted with a "B" suffix. The mounting plate 24P has mounting windows 24-1, 24-2 formed therein.

With reference to FIG. 3 a rotary actuator 124A, such as that actuator sold by Bimba Manufacturing Company, Monee, Ill., as the "Pneu-Turn Rotary Actuator", is secured to the lower surface of the plate 24P. The shaft 126A of the actuator 124A is keyed to the axle 128A of a feed wheel 130A. A portion of the wheel 130A projects through the window 24-1 and extends above the surface of the plate 24P. The wheel is reciprocally rotatable with respect to the plate 24P in the forward and reset directions (i.e., toward and away from the yarn conduction module 22) as indicated by the respective arrows 132A, 133A (FIG. 3).

The axle 128A carries a pinion (not visible) that meshes with a gear rack disposed with the actuator housing. The rack is rectilinearly reciprocally movable with the actuator housing in response to the introduction of an actuating fluid supplied by a suitable supply line (not shown).

A support bracket 144A in the shape of an inverted "U" is secured to the upper surface of the plate 24P. The bracket 144A carries an actuator 146A such as that available from Clipard Instrument Laboratories, Cincinnati, Ohio, as model number 3G. The piston of the actuator 146A is secured to a trunnion 148A (FIG. 3) that supports the axle of a nip roller 150A. Preferably, the nip roller is an elastomeric material while the corresponding feed roller 130 may be formed of a more rigid material, such as aluminum. A pair of fore and aft support arms 152A, 154A extend forwardly and rearwardly from the trunnion 148A. Fore and aft yarn guide eyelets 156A, 158A are mounted to the end of the respective arms 152A, 154A.

The trunnion 148A and associated nip roller 150A just described moves as a unit in respective directions 160A, 162A toward and way from the surface of the feed wheel 130A.

The feed assembly 120B (wherein corresponding parts are denoted by numerals with a "B" suffix) is mounted under the mounting plate 24P and the wheel 130B thereof projects through the window 24-2 formed in the plate 24P.

A feed tube 168A, 168B is mounted in a tube support block 170A, 170B disposed forwardly of each respective feed assembly 120A, 120B. Each feed tube 168A, 168B guides a respective yarn 14, 16 from the fore yarn ceramic guide eyelet 156A, 156B in that yarn's respective feed assembly 120A, 120B toward the associated inlet port 56A, 56B in the yarn conduction block 48.

Figure 6A:
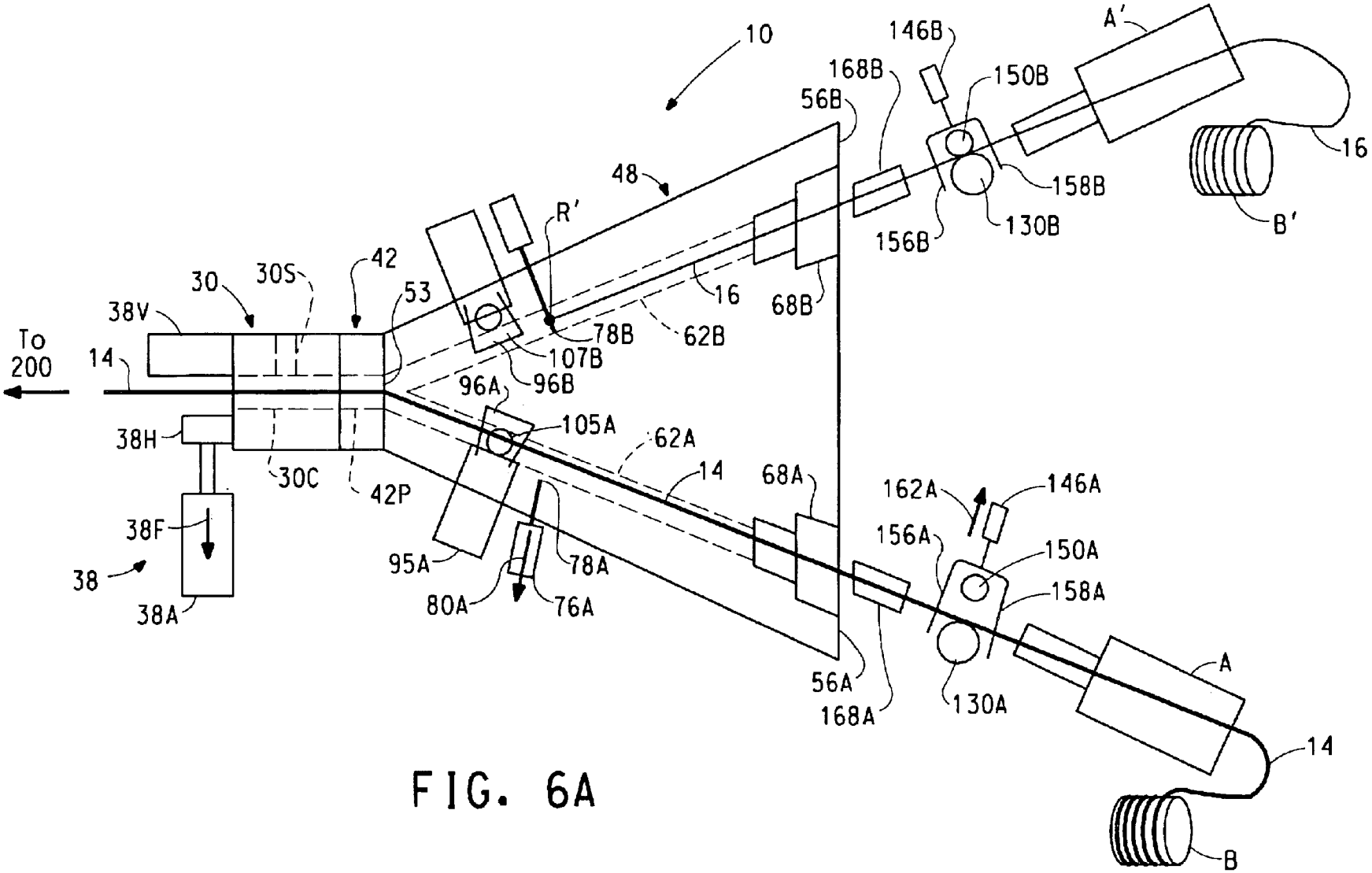

Having described the structure of the yarn splicing apparatus 10 the operation thereof for forming a spliced yarn comprising alternating predetermined lengths of the yarns 14 and 16 by splicing a leading end of the yarn 14 to the trailing end of the yarn 16 may now be described. The operation of the yarn splicing apparatus 10 is believed best understood from the series of diagrammatic views shown in FIGS. 6A through 6L. In the drawings the first yarn 14 is indicated by a bold line while the second yarn is indicated by a fine line. In practice each yarn 14, 16 is supplied to the splicing apparatus 10 from a suitable supply bobbin B, B' (FIG. 6A). To avoid operational disruptions an accumulation of each yarn 14, 16 is held in a respective accumulator assembly A, A' downstream of the respective supply bobbin B, B'. Suitable for use as the accumulator A, A' is the device manufactured by IRO Inc., Charlotte, N.C. and sold as IRO Galaxy RS.H.

FIG. 6A illustrates the status of the various elements of the splicing apparatus 10 at the beginning of an operational cycle. In this state the head 38H of the clamp assembly 38 has been retracted in the direction 38F removing any restriction to yarn passage at the outlet of the interlace jet block 30. The actuator 95A has fully inserted the movable knife blade 96A into the yarn conduction block 48 such that the passage 105A in the movable blade 96A aligns with the channel 62A. The holding cap 78A has been retracted in the direction 80A from the channel 62A. The actuator 146A has withdrawn the nip roller 150A (in the direction 162A) away from contact with the feed wheel 130A. The aspirating jets 68A, 68B are off.

With all interference removed the yarn 14 is free to travel from its bobbin B via its accumulator A, through the aft and fore yarn eyelets 158A, 156A; through the feed tube 168A; through the channel 62A in the yarn conduction block 48; through the perforated tube 42P in the air relief housing 42; and through the channel 30C of the interlace jet block 30 to a user apparatus 200 (as will be discussed). Since the movable blade 96A occupies its inserted position the yarn 14 extends through the passage 105A in the blade 96A as it travels through the channel 62A. In practice, a suitable mechanism, such as a pair of driven nip rolls N (FIG. 7) is disposed forwardly of the splicing apparatus 10 to draw the yarn 14 therethrough.

The channel 62B is interdicted by the body portion 107B of the retracted knife blade 96B and the free end of the yarn 16 is held at a point of repose R' by the extended holding cap 78B. Movement of the yarn 16 is restrained by the engagement of the nip roller 150B and the feed wheel 130B.

Figure 6B:
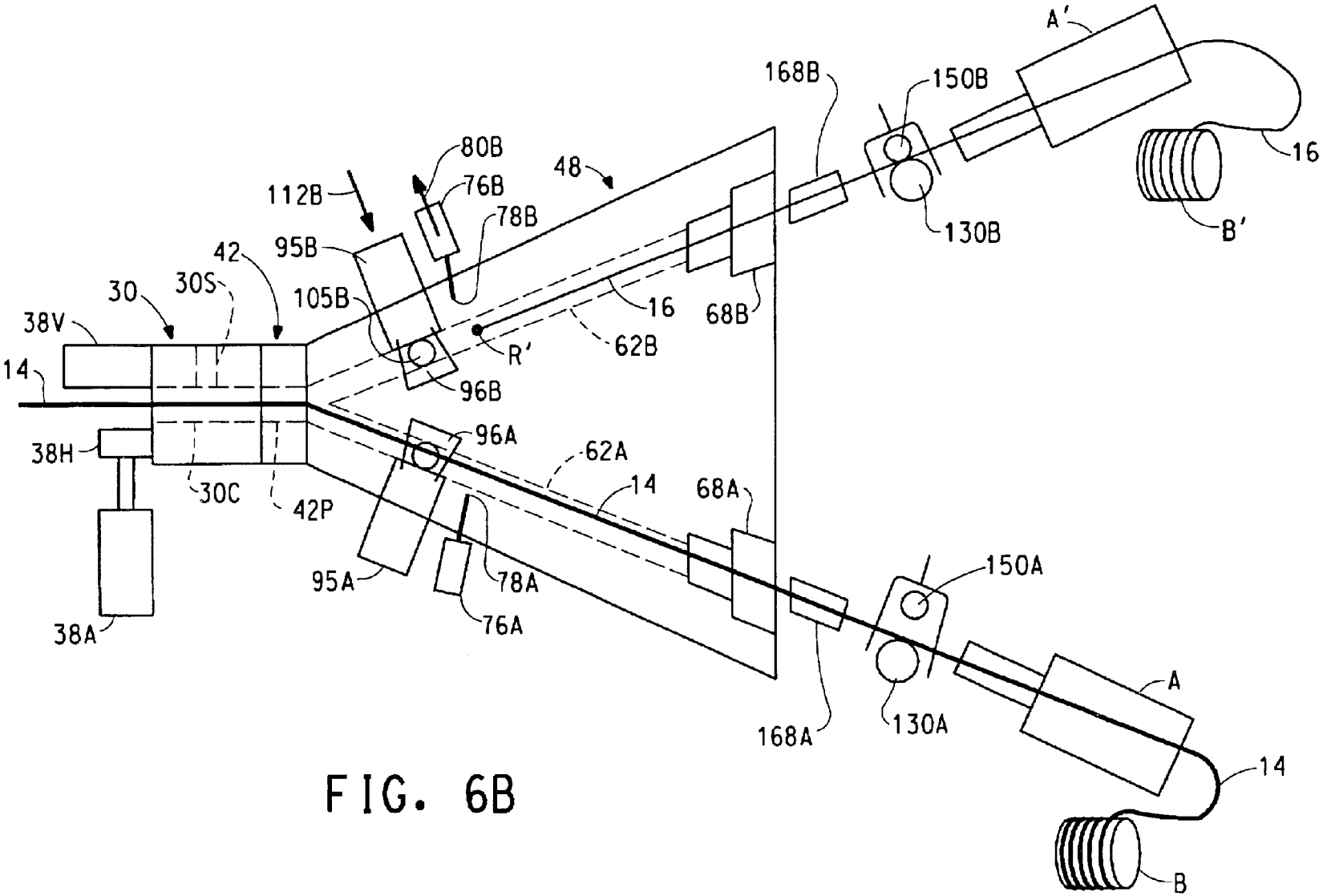

To begin a splicing cycle the actuator 76B is asserted in the direction 80B to withdraw the cap 78B from the channel 62B. Simultaneously, the movable knife blade 96B is extended in the direction 112B to place the passage 105B in the blade 96B into alignment with the channel 62B. These conditions are illustrated in FIG. 6B.

Figure 6C:
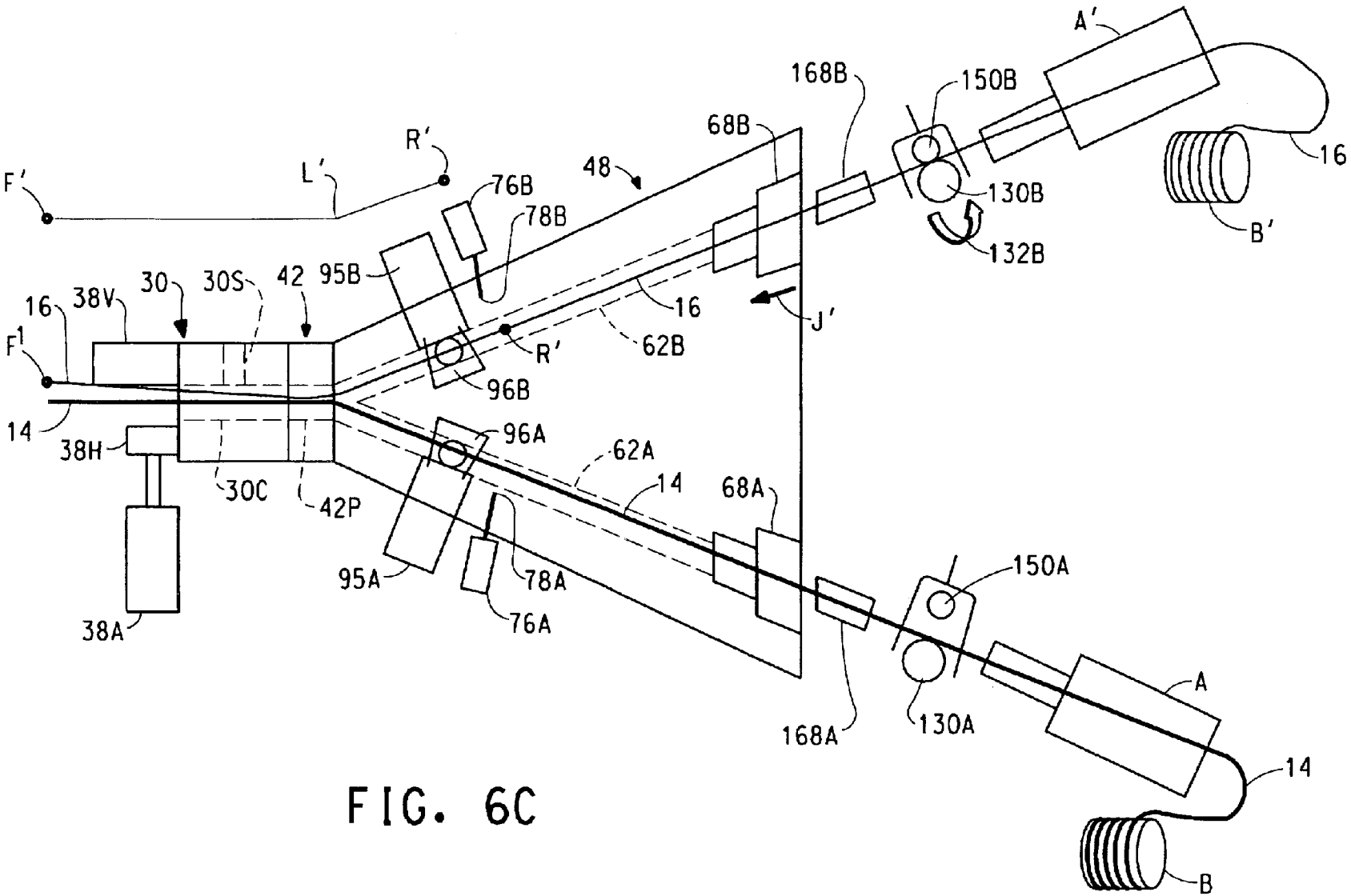

Next, as seen in FIG. 6C, the feed wheel 130B is rotated by its actuator in the direction 132B and the forwarding jet 68B is asserted as indicated by the arrow J'. As a result of these simultaneous actions metered length L' of the yarn 16 advances through the intermingling jet 30. The metered length L' of the yarn 16 is the distance between the initial point of repose R' (FIG. 6A) and the point F' (FIG. 6C) forward of the outlet of the interlace jet 30. The leading end of the yarn 16 thus lies in overlapping relationship with a trailing portion of the yarn 14 in the intermingling channel 30C.

Figure 6D:
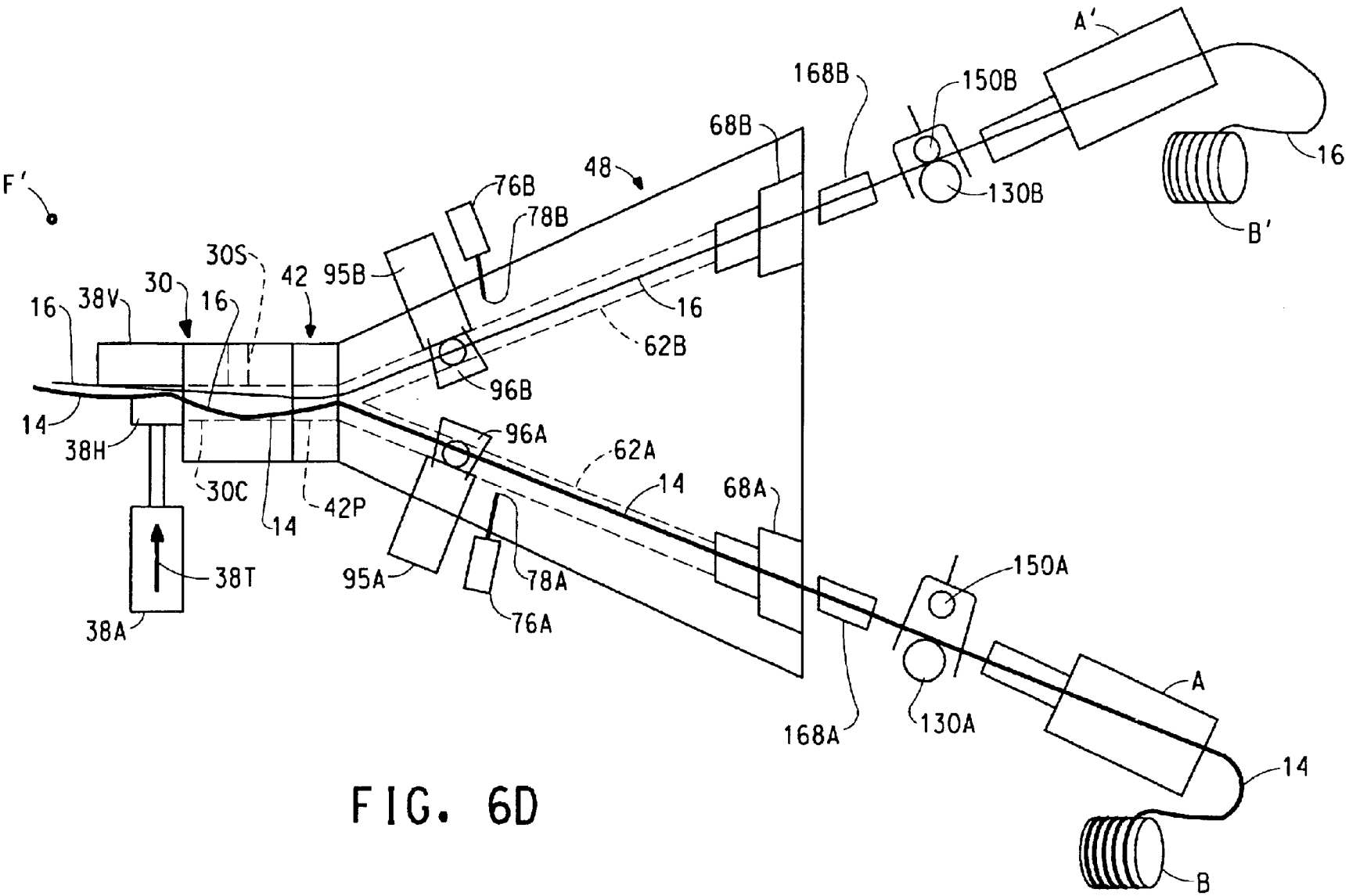

The next action in anticipation of the intermingling is illustrated in FIG. 6D. The actuator 38A is asserted to extend the clamp head 38H in the direction 38T toward the anvil 38V. This action clamps both of the yarns 14, 16 against the pad 38P (FIG. 1) on the anvil 38V and holds both yarns from passing through the intermingling jet.

Figure 6E:
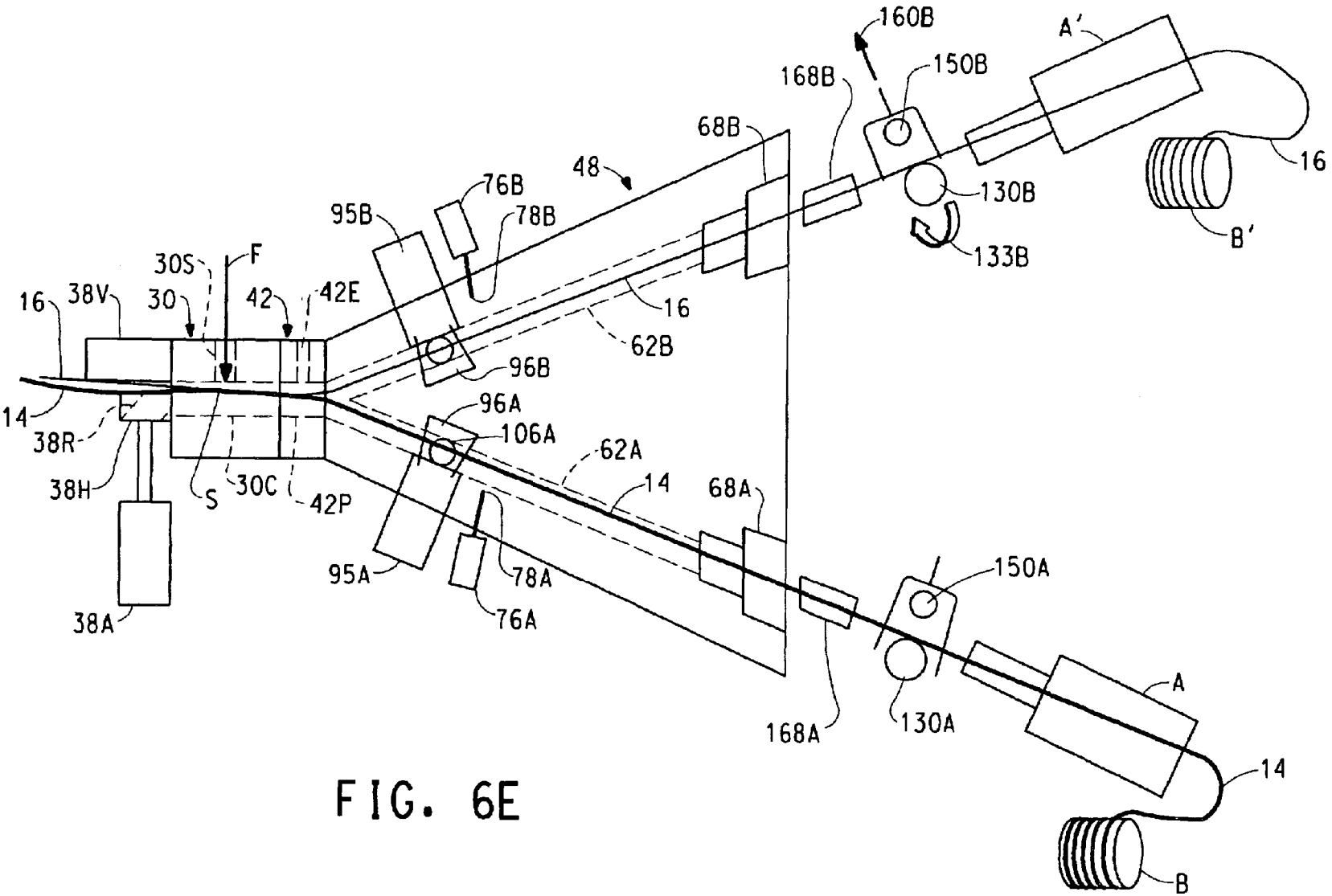

As seen in FIG. 6E the intermingling jet 30 is then asserted and a pressurized intermingling fluid (indicated by the reference arrow F) is introduced through the supply passage 30S into the jet 30. Owing to the structure of the jet 30 (FIG. 4) the intermingling fluid F is introduced on the centerline of the channel 30C and perpendicular with respect thereto. The pressure of the fluid F that forms the intermingled splice is in the range from sixty (60) to one hundred (100) pounds per square inch (413.4 to 689.4 Kilopascals), and more preferably, a pressure in the range from sixty (60) to eighty (80) pounds per square inch (413.4 to 551.2 Kilopascals). (One pound per square inch is 6.894757 Kilopascals.) The duration of the pulse should be at least two hundred milliseconds (200 msec.)

The pressurized fluid F entangles the filaments of the yarns 14, 16 resulting in the formation of an interlaced splice S (FIG. 6E) between the leading portion of the yarn 16 and the trailing portion of the second yarn 14. Although it is possible that the intermingling jet may be actuated and a splice formed while the first yarn 14 is still advancing through the jet 30, it is preferred that both yarns 14, 16 be stopped and held within the jet 30 when the intermingling of filaments occurs.

Owing to the presence of the relief passage 38R in the clamp head 38H and to the perforated tube 42P and escape passage 42E the intermingling fluid F is afforded a vent route from the jet 30.

Upon introduction of the pressurized intermingling fluid F the nip roll 150B withdraws in the direction 160B away from the feed wheel 130B and the feed wheel 130B resets in the direction 133B.

Figure 6F:
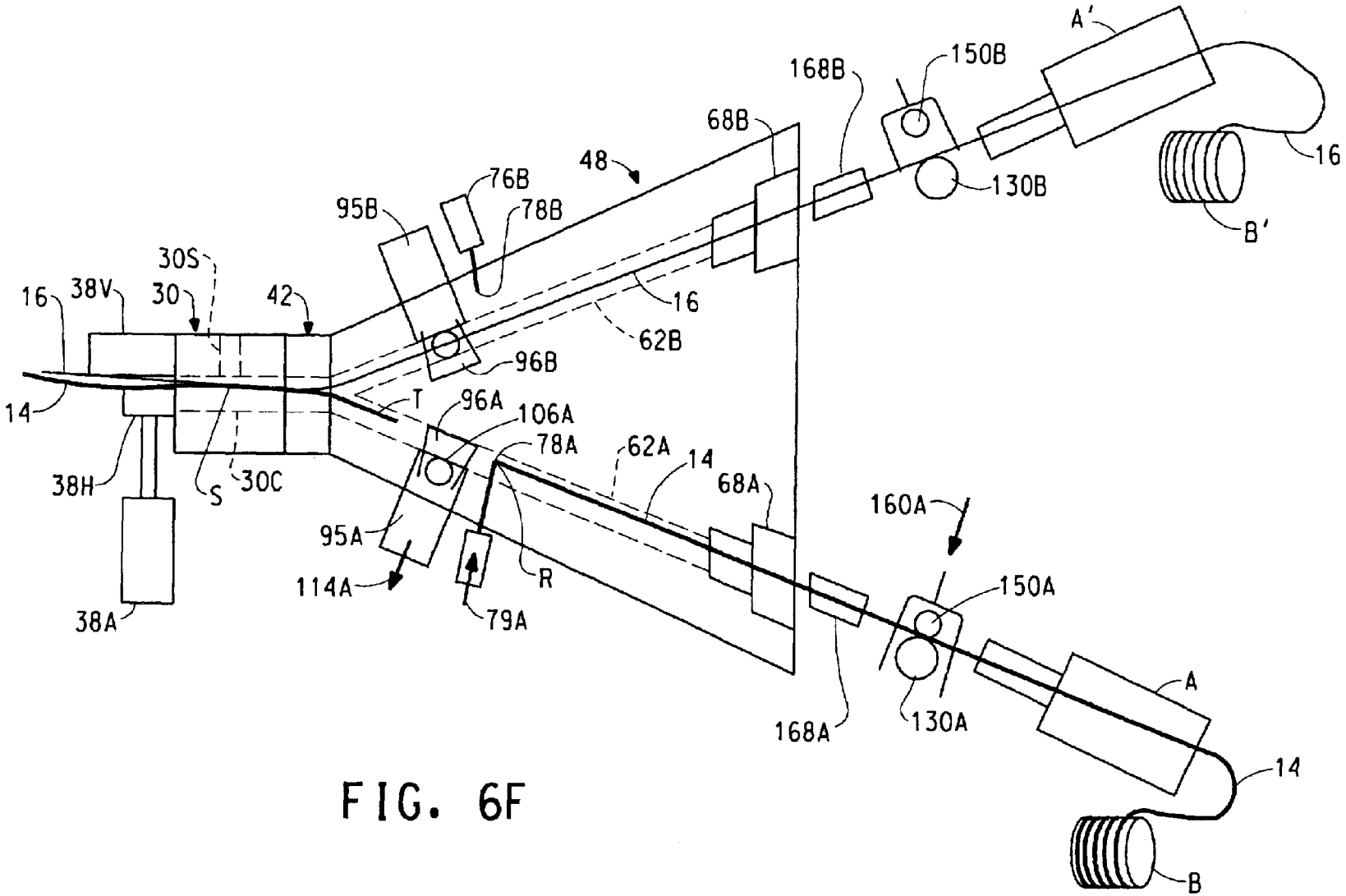

FIG. 6F illustrates the next step in the cycle. With the splice S formed between the yarns 14, 16 the movable blade 96A is retracted from the channel 62A in the direction 114A. This movement brings the cutting edge 106A of the movable blade 96A against the fixed cutting edge 103A (FIG. 3) of the block 48 to sever the yarn 14. The severing action forms a tail T. At about the same time the cap 78A is extended in the direction 79A to hold the free end of the yarn 14 formed by the cut at a point of repose R. The nip roll 130A is extended in the direction 160A toward the wheel 150A to restrain the yarn 14 from further movement.

Figure 6G:
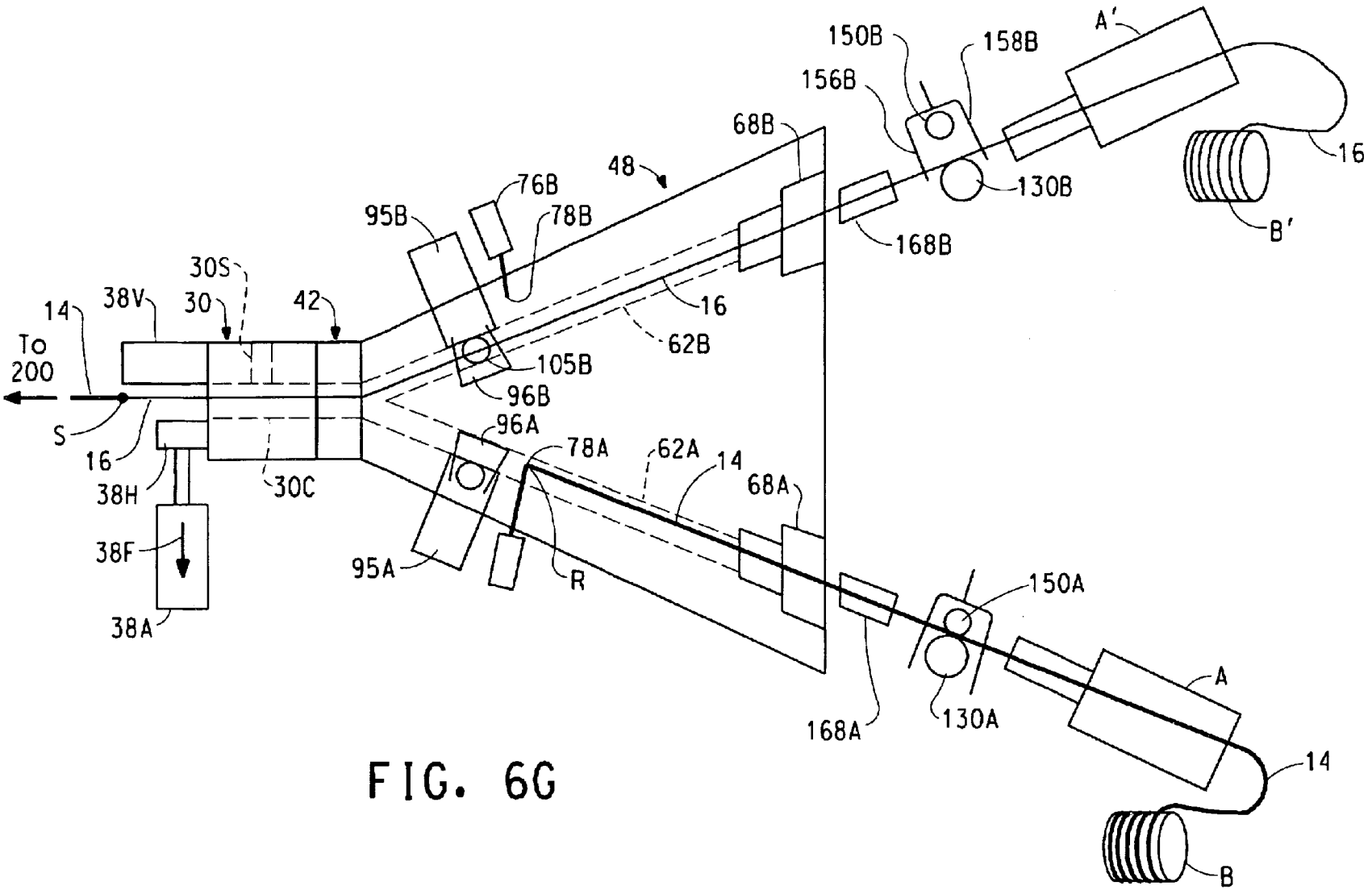

The clamp head 38H is withdrawn in the direction 38F. Since the blade 96B is extended and the holding cap 78B is retracted the yarn 16 is free to follow the interlaced splice S and to travel from its bobbin B' and accumulator A'; through the aft and fore yarn eyelets 158B, 156B; through the yarn guide 168B; through the channel 62B in the yarn conduction block 48; through the perforated tube 42P in the air relief housing 42; and through the channel 30C of the interlace jet block 30 to the user apparatus 200. It is noted that as the yarn 16 travels through the channel 62B it passes through the passage 105B in the movable blade 96B (FIG. 6G).

The yarn 14 remains at its point of repose R while any predetermined desired length of yarn 16 passes to the user apparatus 200.

Owing to the fact that axes of both of the channels 62A, 62B are straight lines, the respective yarn yarns 14, 16 pass through the block 48 with a reduced risk of being hung at a point within the block 48.

When it is desired to switch yarns the alternate of the process as heretofore described is repeated with the yarn 16 being the yarn now drawn through the apparatus 10 and the yarn 14 being the yarn that is forwarded into overlapping relationship therewith.

Figure 6H:
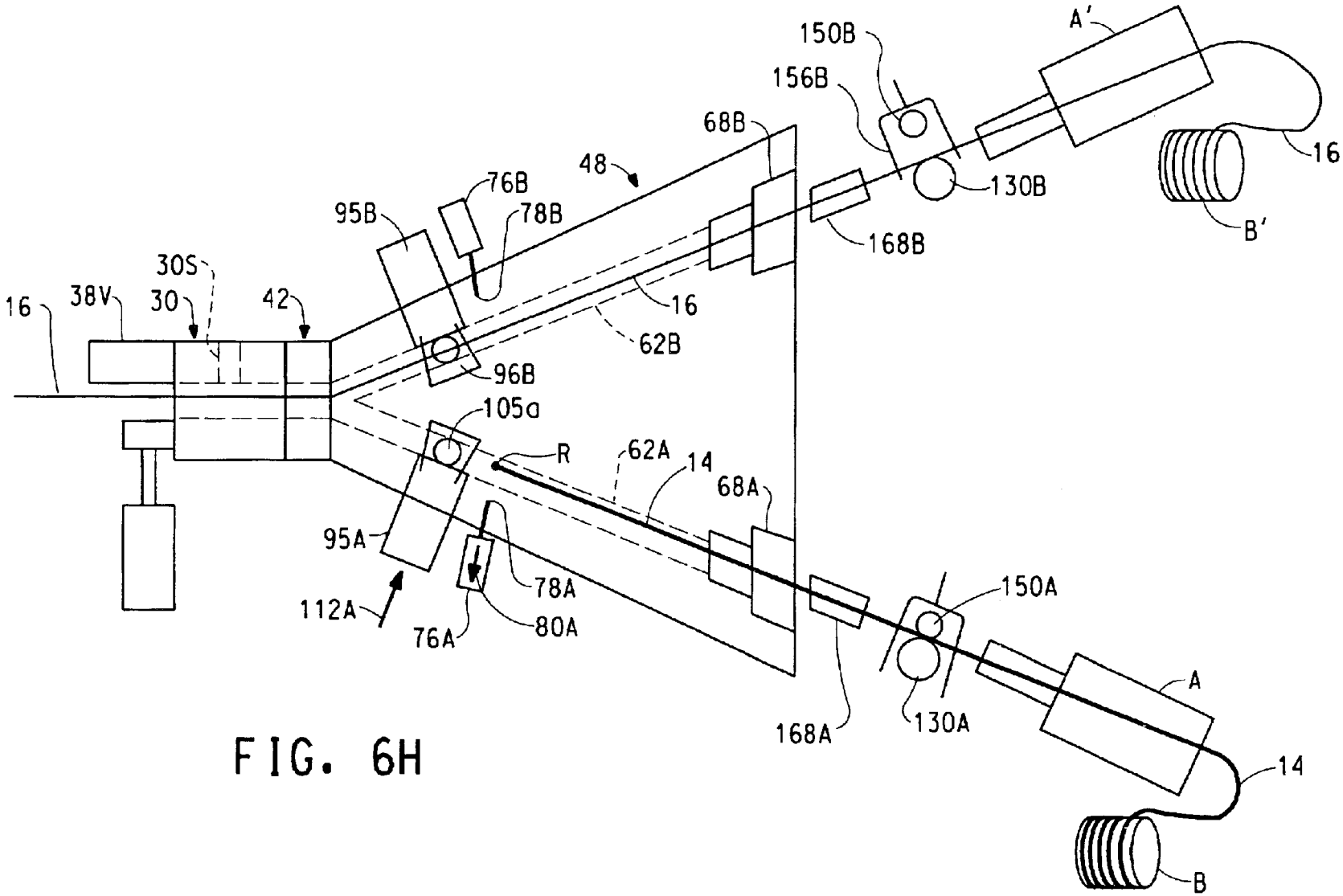
Figure 61:
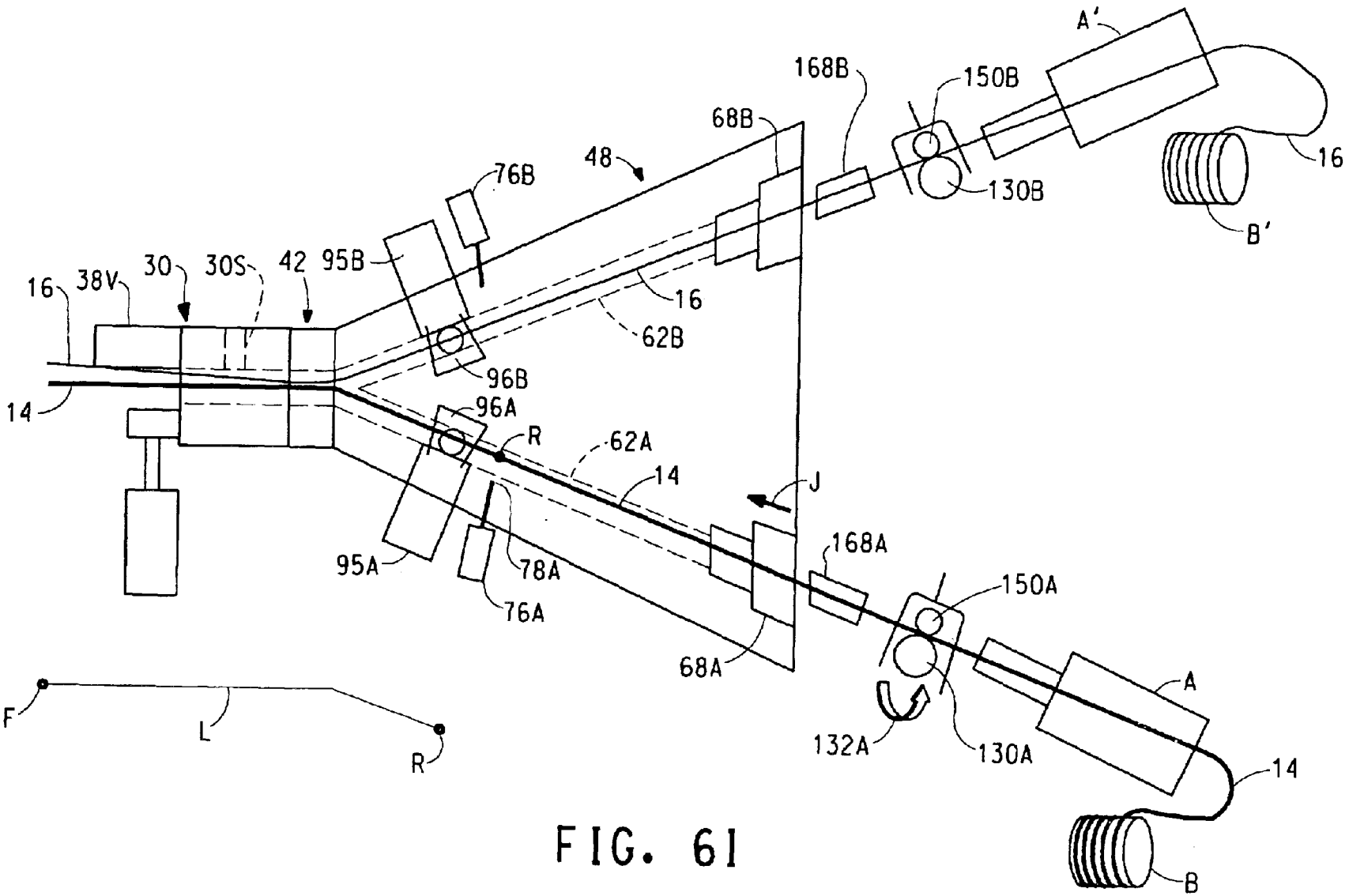

As seen in FIG. 6H, when it is desired to splice the leading end of the yarn 14 to a trailing end of the yarn 16 the actuators 76A and 95A are asserted. These actions respectively withdraw the holding cap 78A and extend the movable blade 96A into the channel 62A. Extension of the movable blade 96A aligns the passage 105A therein with the channel 62A.

In FIG. 6I the feed wheel 130A is rotated by its actuator in the direction 132A and the forwarding jet 68A is asserted (as indicated by the arrow J) to meter a predetermined length L of the yarn 14 through the interlace jet 30. The metered length L of the yarn 14 is equal to the distance between the point of repose R (FIG. 6F) and the point F forward of the outlet of the interlace jet 30.

Figure 6J:
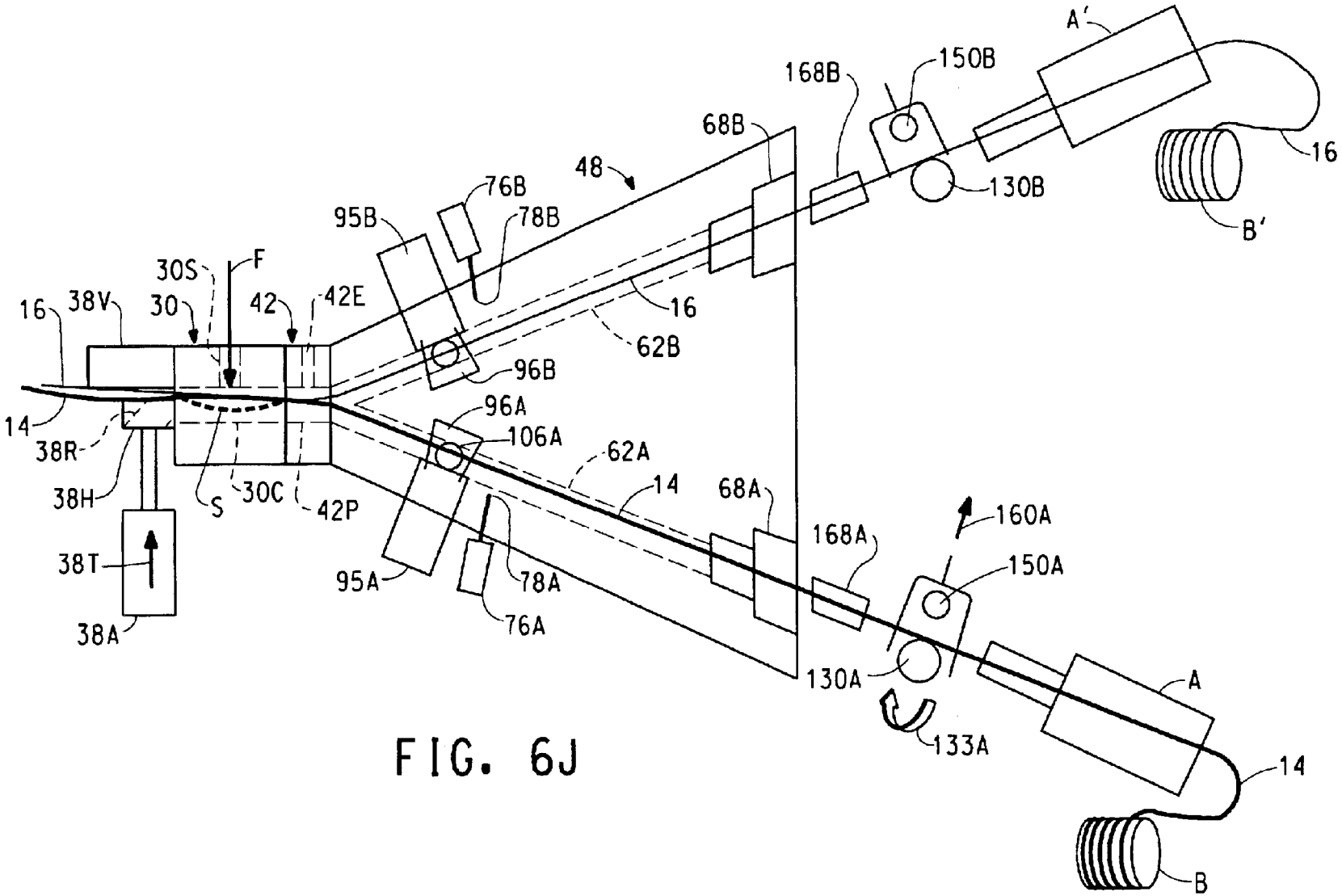

With reference to FIG. 6J the actuator 38A is again asserted to extend the clamp head 38H in the direction 38T toward the anvil 38A, clamping both the yarn 14 and the yarn 16 against the pad 38P (FIG. 2) on the anvil 38V and holding the yarns 14, 16 in the intermingling jet 30 in anticipation of intermingling the second yarn 16 to the first yarn 14. The intermingling jet 30 is then asserted and intermingling fluid F introduced into the jet, resulting in the formation of an interlaced splice S' between the trailing end of the yarn 16 and the leading end of the second yarn 14. The position of the yarn 14 within the intermingling channel 30C prior to the formation of the splice S' is indicated by the dashed lines.

Shortly after the introduction of the pressurized intermingling fluid F the nip roll 150A withdraws in the direction 160A away from the feed wheel 130A and the feed wheel 130A resets in the direction 133A.

Figure 6K:
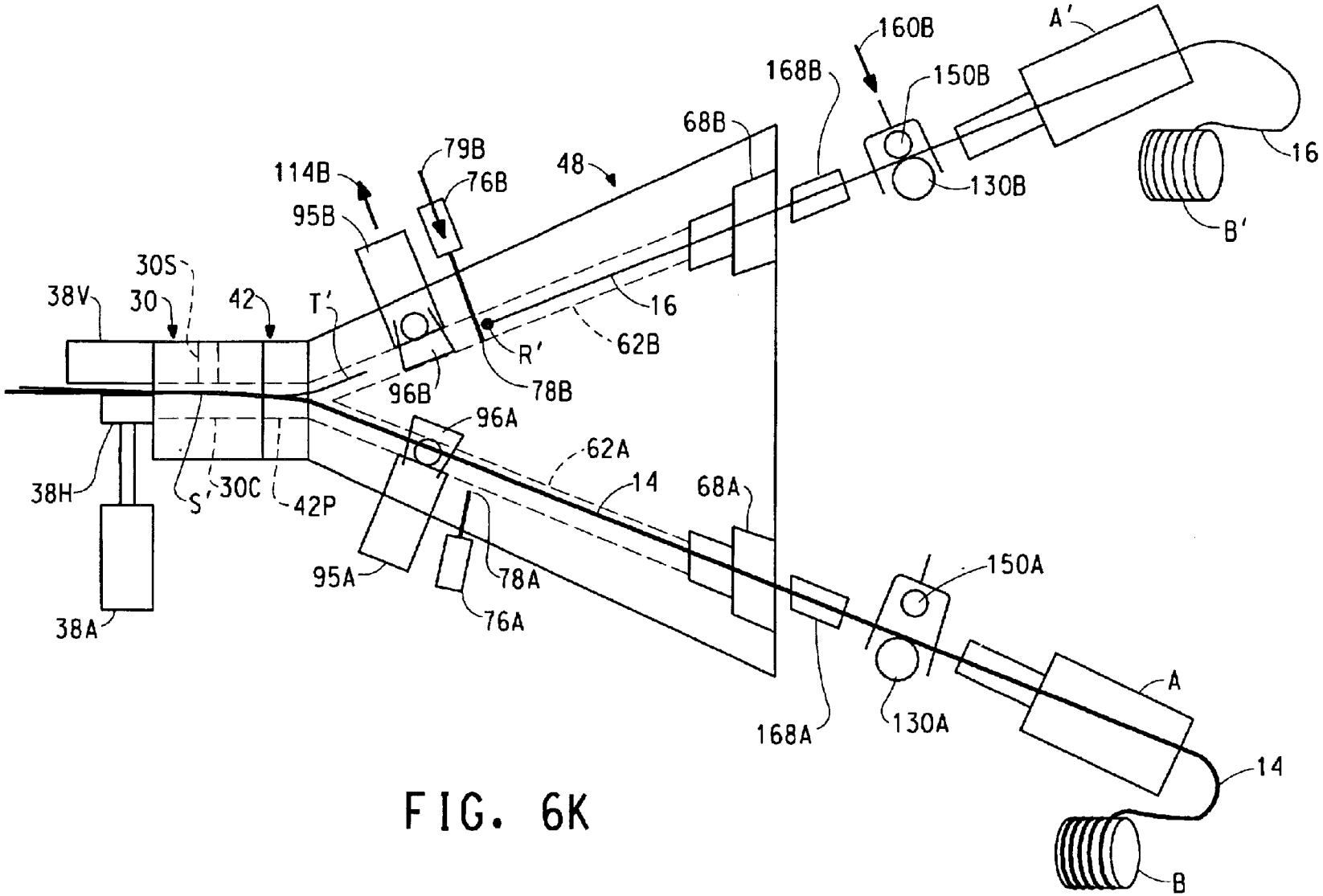

As seen in FIG. 6K, with the splice S' formed the movable blade 96B retracts from the channel 62B in the direction 114B. This movement brings the cutting edge 106B of the movable blade 96B against the fixed cutting blade 103B (FIG. 4) to sever the yarn 16. Another tail T' is formed by this severing action. At about the same time the cap 78B is extended in the direction 79B to hold the free end of the yarn 14 formed by the cut at a point of repose R'. The nip roll 150B extends in the direction 160B toward the wheel 130B to restrain the yarn 16 from movement.

Figure 6L:
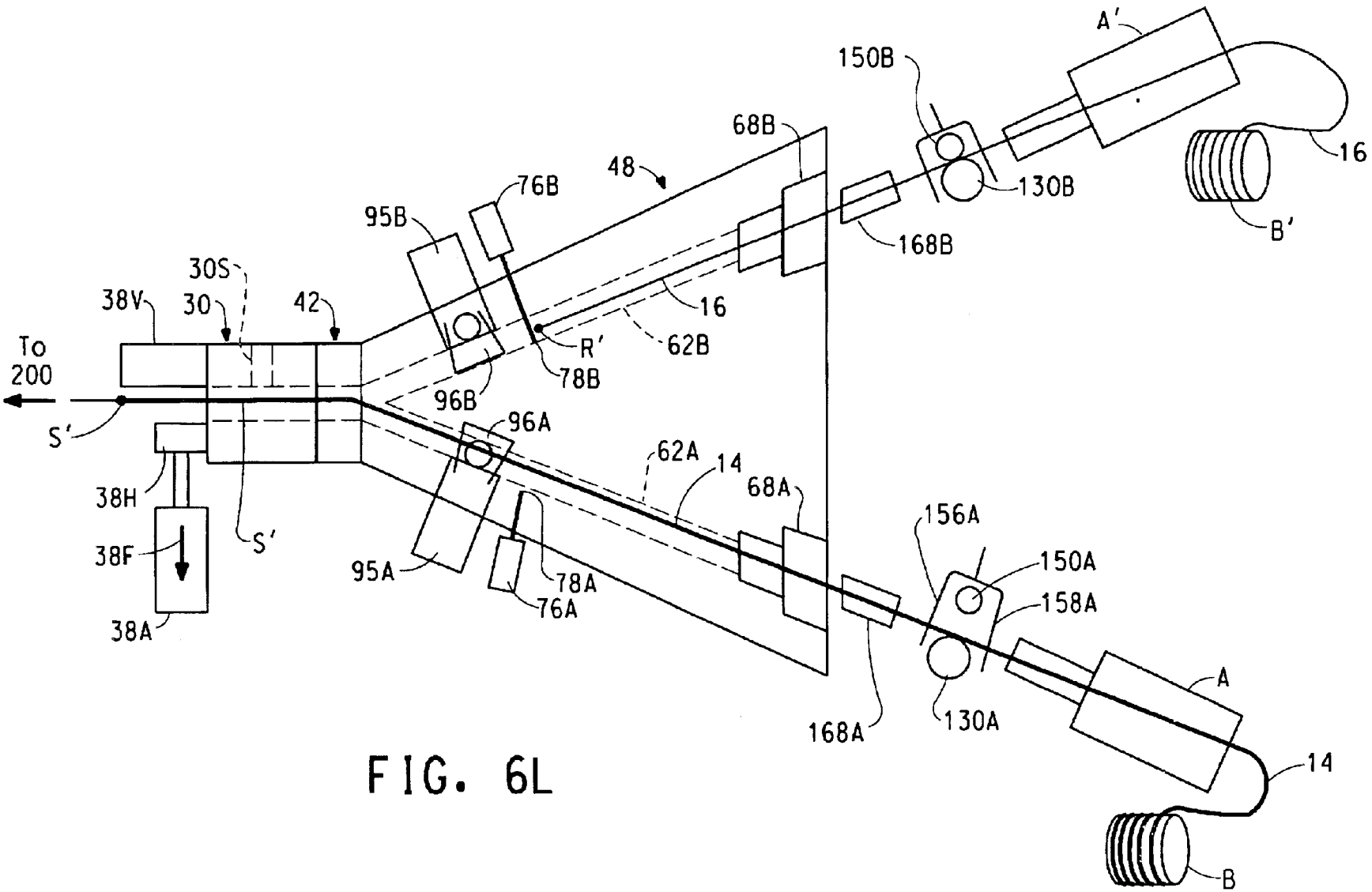

As seen in FIG. 6L the clamp head 38H is withdrawn (in the direction 38F). Since the blade 96A is extended and the cap 78A is retracted the yarn 14 is free to follow the intermingled splice S'. The yarn 14 travels from its accumulator A through the aft and fore yarn eyelets 158A, 156A; through the guide tube 168A; through the channel 62A in the yarn conduction block 48; through the perforated tube 42P in the air relief housing 42; and through the channel 30C of the interlace jet block 30 to the user apparatus 200. The cycle is complete. The yarn 16 lies in the channel 62B at its point of repose R' in anticipation of another splice.

As a result of the method and apparatus of the present invention a spliced yarn 12 is formed that comprises alternating predetermined lengths of a first yarn 14 and a second yarn 16, wherein the trailing end of one of the yarns is joined to the leading end of the other yarn by a fluid entangled splice formed in an intermingling jet. The lengths of the alternating yarns 14, 16 can be equal or different. If different, the lengths can be randomly selected. Each splice S, S' formed as discussed must be able to withstand a tension force of at least 6.8 pounds (3.1 kilograms). Yarn splices formed at the higher pressures in the above-mentioned ranges are be able to withstand a tension force of at least 8.3 pounds (about 3.8 kilograms).

FIG. 7 illustrates a use of the yarn splicing apparatus 10 of the present invention in connection with a user apparatus 200, such as the apparatus for forming a wrapped composite yarn 212 as disclosed in U.S. Pat. No. 6,023,926 (Flynn), assigned to the assignee of the present invention.

Prior to introduction into the user apparatus 200 the spliced yarn 12 produced in the apparatus 10 is drawn by the nip rolls N and a guide jet G and supplied to an accumulator box 210. From the accumulator 210 the spliced yarn 12 passes through a vacuum trimmer 220 where the tails T, T' are trimmed. In the wrapper apparatus 200 the spliced yarn 12 is joined with at least one other yarn Y and wrapped by a wrapper yarn W to form the composite yarn 212. It should be understood that the yarn(s) Y may be derived from any source, including one or more additional splicing apparatus 10 as described herein.

Those skilled in the art, having the benefit of the teachings of the present invention as hereinabove set forth may effect numerous modifications thereto. Such modifications are to be construed as lying within the contemplation of the present invention as defined by the appended claims.

What is claimed is:

1. Apparatus for forming splicing a first and a second yarn comprising:

a yarn conduction member having a first and a second yarn conduction channel extending therethrough, each channel having a predetermined dimension, and an intermingling jet disposed adjacent to the yarn conduction member for forming an air entangled splice between the first and second yarns, the yarn conduction member having a first and second knife blade disposed adjacent to one of the yarn conduction channels, each knife blade having a tip thereon, each blade having a passage defining a cutting edge formed in one portion thereof and a solid portion disposed between the passage and the tip of the blade, the length of the solid portion of the blade being at least equal to the dimension of the passage to which the blade is adjacent, the first and second knives being insertable into and retractable from the channel adjacent thereto, in the inserted position the passage in the knife aligning with the channel adjacent thereto, in the retracted position the solid portion of the blade interdicting the passage to prevent movement of a yarn therethrough, movement of each knife from the inserted to the retracted positions bringing the cutting edge into operative cutting contact with the yarn conduction member, thereby to sever a yarn extending through the passage in the knife.

2. The splicing apparatus of claim 1 further comprising:

a first and a second holding cap disposed adjacent to one of the yarn conduction channels and proximal to a respective one of the knives, each cap being retractable from and insertable into the channel adjacent thereto in correspondence with the respective insertion and retraction of the proximal knife, when inserted into a channel the cap being disposed into abutting contact with the yarn conduction member, the insertion of a cap into a channel upon the corresponding retraction of the proximal knife serving to hold a yarn extending through a channel against the yarn conduction member.

3. The splicing apparatus of claim 1 wherein the yarn conduction member is formed from conjoined first and second housing members, one of the housing members being fabricated from a transparent material.

4. The splicing apparatus of claim 1 wherein each conduction channel extends as a straight line through the yarn conduction member.

5. The splicing apparatus of claim 1 further comprising a clamp disposed forwardly of the yarn conduction, the clamp having a relief passage extending therethrough.

* * * * *